US005622634A

United States Patent [19]

Noma et al.

[11] Patent Number: 5,622,634

[45] Date of Patent: Apr. 22, 1997

[54] METHOD OF MANUFACTURING ELECTRON-EMITTING DEVICE, ELECTRON SOURCE AND IMAGE-FORMING APPARATUS

[75] Inventors: Takashi Noma, Hadano; Seijiro Kato, Yokohama; Fumio Kishi, Kanagawa-ken; Hisaaki Kawade, Yokohama; Toshikazu Ohnishi; Michiyo Nishimura, both of Sagamihara; Kumiko Uno, Urawa; Takahiro Horiguchi, Tokyo; Masato Yamanobe, Machida, all of Japan

[73] Assignee: Canon Kabushiki Kaisha, Tokyo, Japan

[21] Appl. No.: 358,382

[22] Filed: Dec. 19, 1994

[30] Foreign Application Priority Data

| | | | |
|---|---|---|---|
| Dec. 17, 1993 | [JP] | Japan | 5-343280 |
| Dec. 24, 1993 | [JP] | Japan | 5-345930 |
| Jul. 15, 1994 | [JP] | Japan | 6-185162 |
| Jul. 15, 1994 | [JP] | Japan | 6-185177 |
| Aug. 11, 1994 | [JP] | Japan | 6-209377 |
| Dec. 16, 1994 | [JP] | Japan | 6-313276 |

[51] Int. Cl.[6] ..... B44C 1/22

[52] U.S. Cl. ..... 216/40; 216/100; 216/101

[58] Field of Search ..... 216/24, 87, 100, 216/101, 102, 105, 39, 82, 56, 40; 445/24; 313/309

[56] References Cited

U.S. PATENT DOCUMENTS

| | | | |
|---|---|---|---|
| 4,999,083 | 3/1991 | Watanabe et al. | 156/628 |
| 5,066,883 | 11/1991 | Yoshioka et al. | 313/309 |

FOREIGN PATENT DOCUMENTS

| | | |
|---|---|---|
| 0301545 | 2/1989 | European Pat. Off. . |
| 4-308625 | 10/1992 | Japan . |

OTHER PUBLICATIONS

Patent Abstracts of Japan, vol. 014, No. 528 (1990), JP–A–02 223141.

*Primary Examiner*—William Powell

*Attorney, Agent, or Firm*—Fitzpatrick, Cella, Harper & Scinto

[57] ABSTRACT

An electron-emitting device comprising a pair of device electrodes and an electroconductive film including an electron-emitting region is manufactured by a method comprising a process of forming an electroconductive film including steps of forming a pattern on a thin film containing a metal element on the basis of a difference of chemical state, and removing part of the thin film on the basis of the difference of chemical state.

54 Claims, 20 Drawing Sheets

(STRIPE)

(MATRIX)

METHOD OF MANUFACTURING ELECTRON-EMITTING DEVICE, ELECTRON SOURCE AND IMAGE-FORMING APPARATUS

BACKGROUND OF THE INVENTION

1. Field of the Invention

This invention relates to an electron-emitting device, an electron source and an image-forming apparatus comprising such devices and, more particularly, it relates to a method of manufacturing an electron-emitting device.

2. Related Background Art

There have been known two types of electron-emitting device; the thermoelectron type and the cold cathode type. Of these, the cold cathode type include the field emission type and the metal/insulation layer/metal type and the surface conduction type.

A surface conduction electron-emitting device is realized by utilizing the phenomenon that electrons are emitted out of a small thin film formed on a substrate when an electric current is forced to flow in parallel with the film surface. A surface conduction electron-emitting device is typically prepared by arranging a pair of device electrodes on an insulating substrate and an electroconductive film, which may be a metal oxide film, between the electrodes to electrically connecting them and subjecting the thin film to an electrically energizing process referred to as "electric forming" to locally deform or modify the thin film and produce therein an electron-emitting region.

A surface conduction electron-emitting device is a device that shows a sudden and sharp increase in the emission current Ie when the voltage applied thereto exceeds a certain level (a threshold voltage), whereas the emission current is practically undetectable when the applied voltage is found lower than the threshold. Because of this remarkable feature, the emission current of the device can be controlled through the device voltage while the emission charge can be controlled through the duration of time of applying the device voltage. A variety of image-forming apparatuses can be produced, using in combination an electron source realized by arranging a plurality of surface conduction electron-emitting devices and a phosphorous body designed to emit visible light when irradiated with electrons coming from the electron source. With this technique, emissive type display apparatuses having a large display screen capable of displaying high quality images can be produced without difficulty. Hence, such apparatuses are expected to replace CRTs in the future.

Materials that can be used for the electroconductive film of a surface conduction electron-emitting device include, besides metal oxides, metal and carbon. When a metal oxide is used, an organic metal compound is applied to the substrate to form an initial thin film of the compound and then baked in the atmosphere to produce a thin metal oxide film. Massive efforts are currently being paid to fully exploit the potential of this method because it involves a relatively simple manufacturing process and is advantageous relative to other techniques for the formation of thin films.

For the purpose of the present application, "a thin metal oxide film" can partly contain one or more than one metals in addition to a metal oxide.

A patterning operation needs to be carried out to produce an electroconductive film having a desired profile. With a conventional patterning technique, a mask having a desired pattern is formed on an initial thin film and then it is etched to remove unnecessary portions thereof. FIGS. 21A through 21F of the accompanying drawings schematically illustrates steps to be followed for a conventional patterning operation.

Step a: Electrodes 4 and 5 are formed on a substrate 1 (FIG. 21A).

Step b: An initial thin film 201 is formed on the entire surface of the substrate 1 for an electroconductive film (FIG. 21B). Typically, it is a metal film formed by vacuum deposition or sputtering.

Step c: A photoresist 202 is applied to form a layer on the entire surface of the initial thin film (FIG. 21C).

Step d: The applied photoresist is exposed to light, using a mask having a desired pattern, and photographically developed to produce a resist pattern 203 (FIG. 21D).

Step e: The portions of the initial thin film not covered by the resist pattern are removed by wet etching (FIG. 21E). Etchants that can be used for the purpose of the present invention include nitric acid. It is important to select an etchant that is noncorrosive relative to the device electrodes.

Step f: The resist pattern is removed to produce an electroconductive film 204 (FIG. 21F).

While the above technique is popularly used, it may not be used in certain cases as will be described hereinafter. If such is the case, "a lift-off technique" may be a possible alternative. A lift-off technique that can be appropriately used to produce a surface conduction electron-emitting device will be described below by referring to FIGS. 20A through 20K.

Step a: Electrodes 4 and 5 are formed on a substrate 1 (FIG. 20A).

Step b: A metal film, typically a Cr film, is formed (FIG. 20B).

Step c: A resist is applied to form a layer on the entire surface of the metal film (FIG. 20C).

Step d: The applied resist is exposed to light, using a photo-mask having a desired pattern (FIG. 20D).

Step e: The resist is photographically developed (FIG. 20E).

Step f: The Cr film of the portions not covered by the resist are etched by means of an etchant (FIG. 20F).

Step g: The remaining resist is removed to produce a complete Cr mask (FIG. 20G).

Step h: An organic metal compound solution is applied to the product of Step g to form an organic metal thin film 6 (FIG. 20H).

Step i: The organic metal compound thin film 6 is partly turned to a metal oxide thin film as it is baked (FIG. 20I). As described earlier, a metal oxide thin film may contain as part thereof one or more than one metals beside the metal oxide. The baking conditions may appropriately be selected depending on the organic metal compound used for the metal oxide thin film. If it is a complex of palladium acetate and an amine, it is typically baked in the atmosphere at 300° C. for about a little more than 10 minutes.

Step j: An electroconductive thin film 3 of the metal oxide having a desired profile is formed by lifting-off the remaining Cr and removing the unnecessary portions of the metal oxide thin film (FIG. 20J).

Step k: An electron-emitting region 2 is formed in the electroconductive thin film 3 by means of an electric forming process as described earlier (FIG. 20K).

However, the above described known method is accompanied by problems, which will be described below.

In the operation of patterning by etching, the organic metal compound of the initially formed thin film needs to be pyrolyzed under appropriate conditions to produce a metal thin film, onto which resist is applied for the subsequent steps. However, the produced metal thin film is poorly adherent to the substrate and electrodes and can easily come off to totally prevent the operation from proceeding to the next step.

A conceivable method to avoid the problem of poor adhesion is to produce a metal oxide thin film in stead of a metal thin film by heat treatment at appropriate temperature in an oxidizing atmosphere. However, a metal oxide thin film is less liable to be etched with an ordinary etchant such as nitric acid and, therefore, a lift-off technique as cited above has to be normally used. A metal film such as a Cr film is used for the mask of the lift-off operation because photoresist cannot withstand the high temperature of the heat treatment of organic metal compound thin film.

Since this method involves a large number of steps, the overall yield of manufacturing electron- emitting devices of the type under consideration can become rather low. If an electron source comprising a large number of electron-emitting devices is used for an image-forming apparatus, all the devices have to operate because only a small number of defective devices, if exist, can significantly degrade the quality of images formed on the display screen of the apparatus. Thus, a low yield is a vital disadvantage in the manufacture of electron-emitting devices. An effective way to improve the yield will be to reduce the number of steps.

Additionally, the operation of forming a metal film such as a Cr film requires the use of a vacuum system such as a vacuum deposition assembly or a sputtering assembly, which is very costly, and a very large electron source comprising a number of electron-emitting devices arranged in array cannot feasibly be manufactured. This latter problem makes it abortive to fully exploit the advantage of the technique of applying an organic metal compound to produce a large processed surface area for a multiple type electron source. If, on the other hand, a lift-off technique is used to produce a large processed area, there can arise problems is in the course of processing such as exfoliation and undesired re-adhesion of thin film.

In view of the above problems and other problems, it is desired to develop a process of manufacturing electron-emitting devices that involves only a reduced number of steps and does not require the use of a vacuum system.

SUMMARY OF THE INVENTION

It is, therefore, an object of the present invention to provide a method of manufacturing an electron-emitting device, an electron source and an image-forming apparatus comprising such devices in a short period of time at remarkably low cost. Such a method will be particularly advantageous in the manufacture of a multiple type electron source having a large surface area.

Another object of the invention is to provide a method of manufacturing an image-forming apparatus comprising a large number of electron-emitting devices with a reduced number of steps that can minimize the rate of malfunction of the devices and hence of the display screen of the apparatus.

According to a first aspect of the invention, the above objects and other objects of the invention are achieved by providing a method of manufacturing an electron-emitting device comprising a pair of device electrodes and an electroconductive film including an electron-emitting region, said method comprising a process of forming an electroconductive film including steps of forming a pattern on a thin film containing a metal element on the basis of a difference of chemical state and removing part of the thin film on the basis of the difference of chemical state.

According to a second aspect of the invention, there is provided a method of manufacturing an electron source comprising a substrate and a plurality of electron-emitting devices manufactured by a method according to a first aspect of the invention and arranged in array on the substrate, each comprising a pair of device electrodes and an electroconductive film including an electron-emitting region.

According to a third aspect of the invention, there is provided a method of manufacturing an image-forming apparatus comprising an electron source comprising a substrate and a plurality of electron-emitting devices arranged in array on the substrate, each comprising a pair of device electrodes and an electroconductive film including an electron-emitting region, and manufactured according a second aspect of the invention, modulation means for modulating electron beams emitted from the electron source, an image-forming member for forming images thereon when irradiated with electron beams emitted from the electron source.

DETAILED DESCRIPTION OF THE PREFERRED EMBODIMENTS

FIGS. 1A through 1E schematically show different but essential steps of manufacturing an electron-emitting device by a method according to the invention.

Figure 1A:
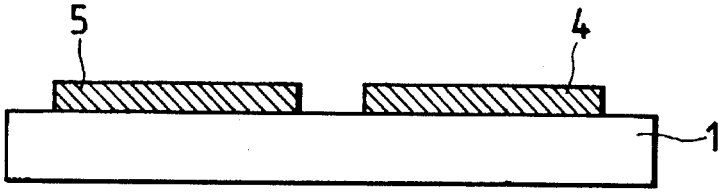
FIGS. 1A through 1E schematically show different steps of manufacturing an electron-emitting device by a method according to the invention.

(a) A pair of oppositely disposed device electrodes 4 and 5 are formed on an insulating substrate 1 (FIG. 1A).

Materials that can be used for the substrate include quartz glass, glass containing impurities such as Na to a reduced concentration level, soda lime glass, glass substrate realized by forming an $SiO_2$ layer on soda lime glass by sputtering, ceramic substances such as alumina.

While the oppositely arranged device electrodes 4 and 5 may be made of any highly electroconductive material, preferred candidate materials include metals such as Ni, Cr, Au, Mo, W, Pt, Ti, Al, Cu and Pd and their alloys, printable conductive materials made of a metal or a metal oxide selected from Pd, Ag, Au, $RuO_2$ and Pd—Ag and glass, transparent conductive materials such as $In_2O_3$—$SnO_2$ and semiconductor materials such as polysilicon.

As will be described hereinafter, a wet-etching technique is used in the step of forming an electroconductive film in some of the preferred modes of realizing the present invention. If such is the case, a material that is not eroded by the etchant employed for wet-etching needs to be selected for the device electrodes.

Figure 1B:
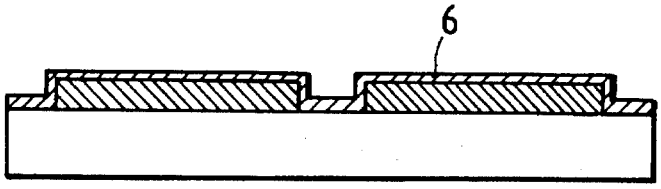

(b) A film 6 of an organic metal compound is formed between the device electrodes 4 and 5 so that an electroconductive film including an electron-emitting region can be formed out of it in (e) below (FIG. 1B).

Materials that can be used for forming an electroconductive film include oxides of metals such as Ru, Ni, Pd, In, Cu, Fe, Zn, Sn, Ta, W, and Pb. On the other hand, materials that can be used for forming an organic metal compound film 6 prior to the formation of an electroconductive film include organic metal compounds containing any of the above listed metals such as alkoxides, chelate compounds, complex salts, salts of organic acids and organic compounds having one or more than one carbon-metal bonds.

The selected organic metal compound is then applied to the substrate 1 by dissolving or dispersing it in a solvent and using an appropriate technique such dispersed application, dipping or spin-coating. While any solvents may be used for this step, preferred candidates include butylacetate, acetone, toluen, hexane, water and ethanol.

Figure 1C:
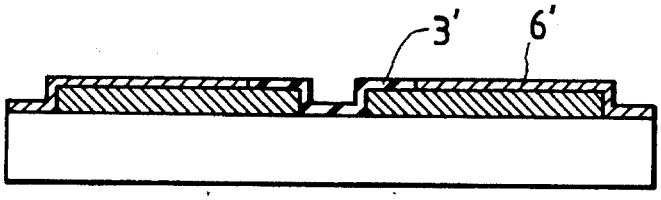

(c) A difference of chemical state is imparted to portion 3' of the organic metal compound film where an electroconductive thin film including an electron-emitting region is to be formed in (e) below and the remaining portion 6' of the film (FIG. 1C). For the purpose of the present invention, "a difference of chemical state" can be typically defined in terms of two chemically different states of a common element such as a metal and an oxide of the metal, an oxide of a metal and an organic compound of the metal or a portion of an organic metal compound that has been decomposed to a considerable extent and the remaining portion of the organic metal compound that has not been decomposed.

Figure 1D:
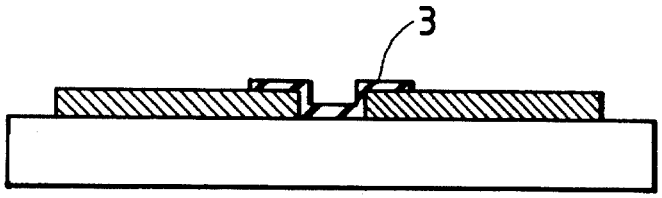

(d) The portion of the film of the organic metal compound or a decomposition product thereof that is not used for an electroconductive thin film including an electron-emitting region is selectively removed (FIG. 1D). Techniques that can be used for this step include etching, collapse by physical impact, washing with an organic solvent and sublimation.

If the remaining portion of the thin film has not turned into a metal oxide film in this step, it has to be oxidized to make a metal oxide film or an electroconductive film 3, out of which an electron-emitting region is to be formed.

Figure 1E:
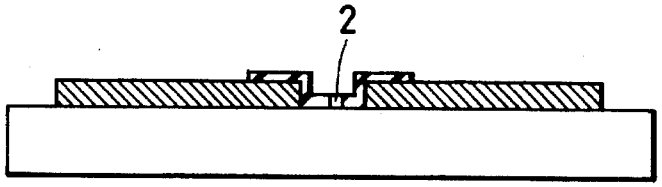

(e) An electrically energizing operation, which is also called an electric forming operation, is conducted on the electroconductive film 3 prepared in (d) above to produce an electron-emitting region 2 by applying a voltage between the electrodes 4 and 5 (FIG. 1E).

Now, the present invention will be described further in greater detail by way of preferred mode of realizing the invention.

[Mode 1]

A first preferred mode of realizing the present invention will be described.

In this mode, the step of forming an electroconductive film, out of which an electron-emitting region is to be formed, comprises steps of forming an organic metal compound thin film and thereafter turning it into a metal oxide thin film through heat treatment in an oxidizing atmosphere, forming a cover on a portion of the organic metal compound thin film to make a thin film including an electron-emitting region, reducing the metal oxide of all the thin film except the portion where the cover has been formed and selectively removing the portion of the thin film where the metal oxide has been reduced.

Techniques that can be used to remove the portion of the thin film where the metal oxide has been reduced include the use of an appropriate etchant for dissolving the thin film and the use of a physical impact that can be generated by ultrasonic waves in order to make use of the relatively weak adhesive force of a metal thin film relative to the substrate.

Figure 2A:
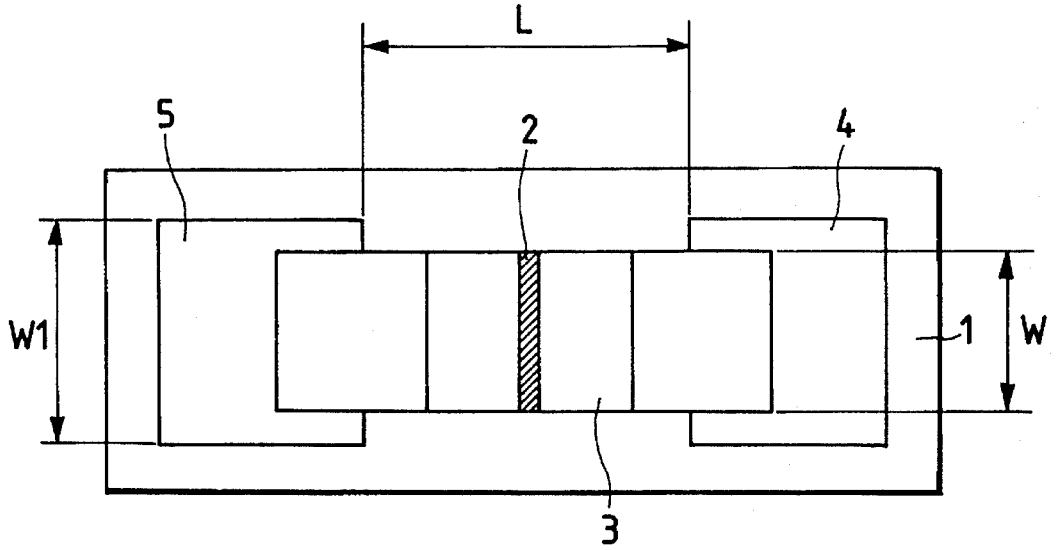
FIGS. 2A and 2B are schematic views of an electron-emitting device manufacture by a method according to the invention.
Figure 2B:
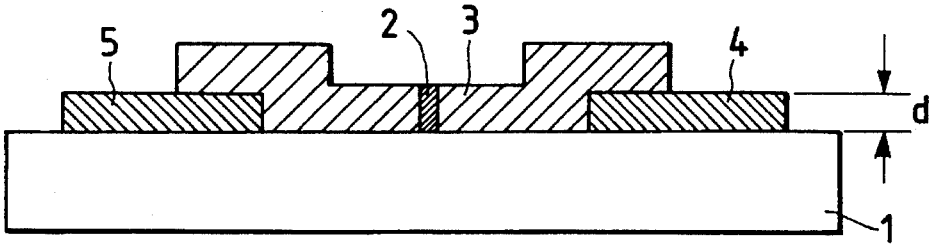

Now, this mode will be described by referring to FIGS. 5A through 5F illustrating different steps of manufacturing a surface conduction electron-emitting device as shown in FIGS. 2A and 2B. Note that steps a through f described below respectively correspond to FIGS. 5A through 5F.

Step a: After thoroughly cleaning a substrate 1 with a detergent, pure water and an organic solvent, a pair of device electrodes 4 and 5 are formed on the insulating substrate 1 by any appropriate means such as a combination of vacuum deposition or sputtering and photolithography or printing.

Step b: An organic metal compound film is formed on the substrate 1 carrying thereon the device electrodes 4 and 5 by applying the compound, which is then baked to produce a metal oxide thin film.

The organic metal compound is an organic compound containing as a principal ingredient the metal with which an electroconductive thin film for producing an electron-emitting region is formed. It can be selected from alkoxides, chelate compounds, complex salts, salts of organic acids and organic compounds having one or more than one carbon-metal bonds containing the metal as a principal ingredient.

The selected organic metal compound is then applied to the substrate 1 by dissolving or dispersing it in a solvent and using an appropriate technique such dispersed application, dipping or spin-coating. While any solvents may be used for this step, preferred candidates include butylacetate, acetone, toluen, hexane, water and ethanol.

The temperature at which the organic metal compound is baked is such temperature that can decompose the compound and produce oxide of the metal.

Step b can alternatively be carried out in the following manner.

A metal film is formed on the substrate 1 carrying thereon a pair of device electrodes 4 and 5 by means of an appropriate technique of thin film deposition such as sputtering or vacuum deposition and then the metal film is heat treated at appropriate temperature to produce a metal oxide film. The temperature of the heat treatment depends on the metal, although care should be taken in the selection of the metal and the material of the electrodes so that neither the electrodes nor the metal oxide may be damaged by the heat treatment.

Step c: A cover 8 is formed on a portion of the metal oxide thin film 7 where an electroconductive film 3 including an electron-emitting region is to be formed.

The cover 8 is designed to prevent the reducing agent from touching the portion of the thin film 7 that is to be turned into an electroconductive thin film 3 including an electron-emitting region in the reducing step that follows.

Materials that can be used for the cover 8 include polymers such as polyurethane, epoxy, phenoxy, polyamide, fluorocarbon, polyxylene, polyester, polyvinyl, polystyrene, acryl, arylpolmer, polyamide, phenol resin and polysulfide.

Methods that can be used for coating the thin film with a polymer include compressed liquid spray for spraying a solution of a polymer or a precursor thereof, airless spray, vapor spray, dipping, brushing, roller coating, impregnation, rotary application, the LB technique, dispersion coating using as a powdered polymer dispersed in water, flame spray using a powdered polymer, fluidized dipping and application of electrostatic powder.

Method that can be used for producing a cover 8 with a desired profile include a method involving the use of a photosensitive resin material and silk screen printing.

Step d: The thin film 7 except the portion covered by the cover 8 is subjected to a reducing operation to obtain a metal film 9. The reducing operation is carried out either in a reducing solution or in a reducing atmosphere.

If a reducing solution is used, materials that can be used for the operation include hydrazine, diimde, formic acid, aldehyde and L-ascorbic acid. While the temperature of the reducing solution for carrying out the reducing operation depends on the type and the density of the solution, it is preferably between 20° C. and 100° C.

If, on the other hand, a reducing atmosphere is preferred, materials that can be used for the operation include hydrogen and carbon monoxide diluted by nitrogen or argon.

Step e: The metal film 9 is selectively etched to produce an electroconductive thin film 3 having a desired profile and containing a metal oxide.

The solution to be used for the selective etching operation is required to solve the metal but hardly solve the oxide of the metal. Nitric acid can be advantageously used if the metal is palladium and the metal oxide is palladium oxide.

The etching solution may be a solution that decomposes or dissolves the cover 8. If such is the case, the cover 8 is removed as the metal film 9 is etched. If not, the cover 8 needs to be removed before or after the etching operation. The cover 8 can be removed by an appropriate technique involving the use of a solvent or ashing.

The metal film 9 can be etched after removing the cover by means of an appropriate remover. Alternatively, the metal film can be removed by means of physical impact that can be generated by ultrasonic waves in order to make use of the weak adhesive force of a metal thin film relative to the substrate as compared with a metal oxide film.

Step f: Subsequently, the thin film is subjected to an electrically energizing operation called "electric forming". As the thin film is electrically energized by applying a voltage to the device electrodes 4 and 5 from a power source (not shown), an electron-emitting region 2 having a modified structure is formed in part of the electroconductive thin film 3. The electron-emitting region 2 is a portion of the electroconductive thin film 3 that has been structurally and locally destroyed, deformed or changed by the electrically energizing operation.

Figure 6A:
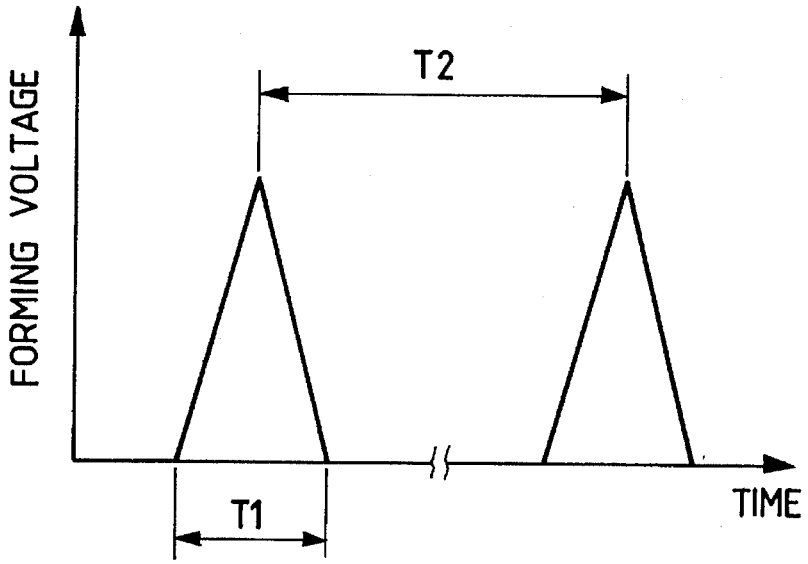
FIGS. 6A and 6B are graphs of two possible voltage waveforms that can be used for an electric forming operation.
Figure 6B:
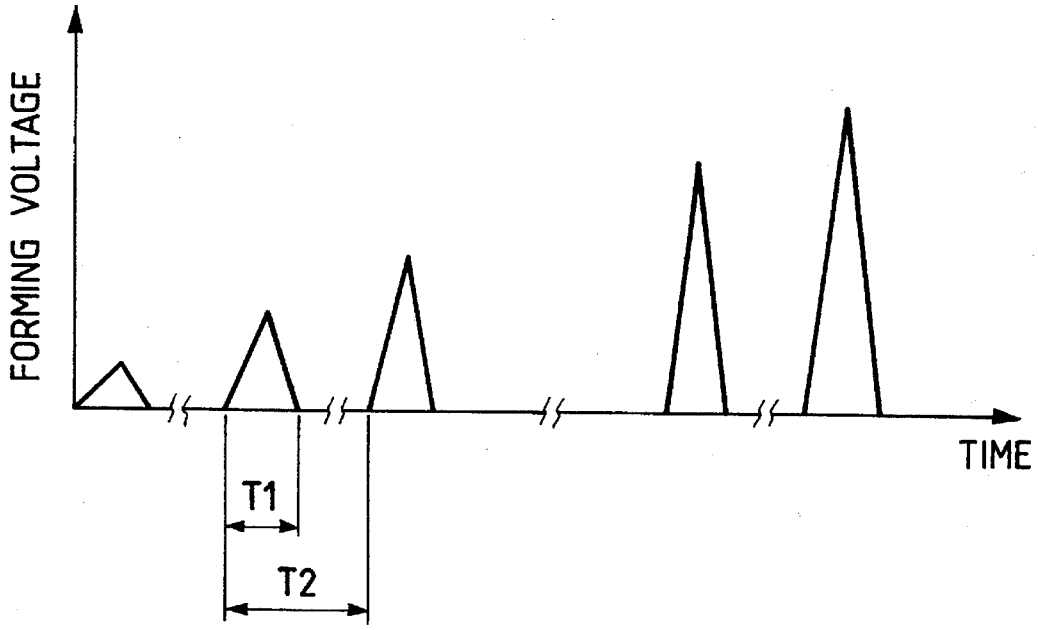

FIGS. 6A and 6B are graphs of two possible voltage waveforms that can be used for an electric forming operation.

For the electric forming operation, a voltage having a pulse waveform is advantageously used. A pulse voltage may be a constant pulse voltage having a constant pulse height (FIG. 6A) or an increasing pulse voltage showing pulses with increasing pulse heights (FIG. 6B).

The operation using a constant pulse voltage will be described first by referring to FIG. 6A, showing a pulse voltage having a constant pulse height. In FIG. 6A, the pulse voltage has a pulse width T1 and a pulse interval T2, which are between 1 and 10 microseconds and between 10 and 100 milliseconds respectively. The height of the triangular wave (the peak voltage for the electric forming operation) may be appropriately selected so long as the voltage is applied in vacuum for an overall time period of several to tens of several seconds. While a triangular pulse voltage is applied to the device electrodes to form an electron-emitting region in an electric forming operation in the above description, the pulse voltage may have a different waveform such as a rectangular waveform.

FIG. 6B shows a pulse voltage whose pulse height increases with time. In FIG. 6B, the pulse voltage has an width T1 and a pulse interval T2, which are between 1 and 10 microseconds and between 10 and 100 milliseconds respectively as in the case of FIG. 6A. However, the height of the triangular wave (the peak voltage for the electric forming operation) is increased at a rate of, for instance, 0.1 V per step in vacuum.

The electric forming operation is terminated when a voltage that is low enough and does not locally destroy, deform or change the electroconductive film 3, for example 0.1 V, is applied in an pulse interval T2 and the device shows a resistance that exceeds an appropriate corresponding level, for example 1M ohms, against the device current.

The device that has undergone the above steps is then preferably subjected to an activation step which will be described below.

In this activation step, a pulse voltage having a constant wave height is repeatedly applied to the device in vacuum of a degree typically between $10^{-4}$ and $10^{-5}$ Torr as in the case of the forming operation so that carbon or carbon compounds may be deposited on the electron-emitting region 2 of the device out of the organic substances existing in the vacuum in order to obtain an electron-emitting device having a high device current and a high emission current. This activation step is preferably conducted while constantly monitoring the device current and the emission current so that the operation may be terminated when the emission current has reached a saturated level. The height of the pulse wave used in this activation step is preferably that of the pulse wave of the drive voltage to be applied to a finished device in normal operation.

The carbon or carbon compounds as referred to above mostly graphite (both single crystal and poly-crystalline) and non-crystalline carbon (or a mixture of non-crystalline carbon and poly-crystalline graphite) and the thickness of the film deposit is preferably less than 500 angstroms and more preferably less than 3,000 angstroms.

A surface conduction electron-emitting device prepared in a manner as described above has functional features as will be described hereinafter.

Figure 3:
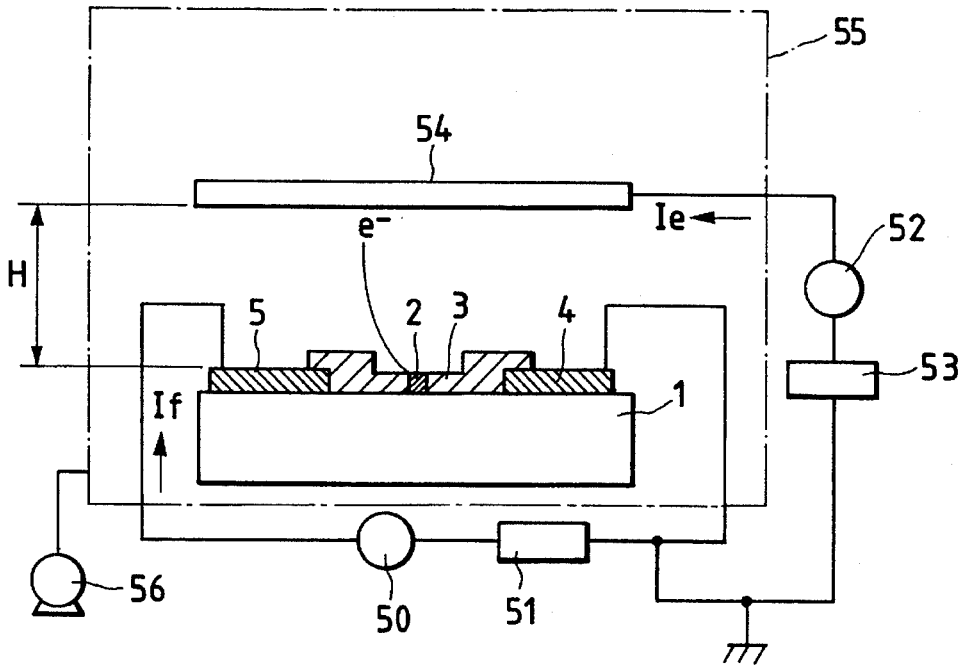
FIG. 3 is a block diagram of a gauging system for determining the performance of a surface-conduction type electron-emitting device manufactured by a method according to the invention.

FIG. 3 is a schematic block diagram of a gauging system for determining the electron emitting performance of a surface conduction electron-emitting device.

In FIG. 3, a surface conduction electron-emitting device is placed in the gauging system and has components denoted by respective reference numerals that are same as those used in FIGS. 1A through 1E and FIGS. 2A and 2B. Otherwise, the gauging system comprises a power source 51 for applying a device voltage Vf to the device, an ammeter 50 for metering the device current If running through the thin film 3 between the device electrodes 4 and 5, an anode 54 for capturing the emission current Ie emitted from the electron-emitting region 2 of the device, a high voltage source 53 for applying a voltage to the anode 54 and another ammeter 52 for metering the emission current Ie emitted from the electron-emitting region 3 of the device. Reference numeral 55 generally denotes the vacuum chamber of the gauging system and reference numeral 56 denotes an exhaust pump.

The electron-emitting device to be tested and the anode 54 are put into the vacuum chamber 55, which is provided with an vacuum gauge and other necessary instruments (not shown) so that the metering operation can be conducted under a desired vacuum condition.

The exhaust pump 56 has an ordinary high vacuum system comprising a turbo pump and a rotary pump and an ultrahigh vacuum system comprising an ion pump and other components. A heater (not shown) is also provided to heat the entire vacuum chamber 55 and the substrate 1 of the device up to about 200° C.

For determining the performance of the device, a voltage between 1 and 10 KV is normally applied to the anode 54, which is spaced apart from the electron-emitting device by a distance H between 2 and 8 mm.

Some of the functional features of a surface conduction electron-emitting device are as follows.

Firstly, the relationship between the device voltage Vf and the emission current Ie and the device current If typically observed through a gauging system as described above is shown in FIG. 4. Note that different units are arbitrarily selected for Ie and If in FIG. 4 because the emission current Ie is significantly lower than the device current If.

Figure 4:
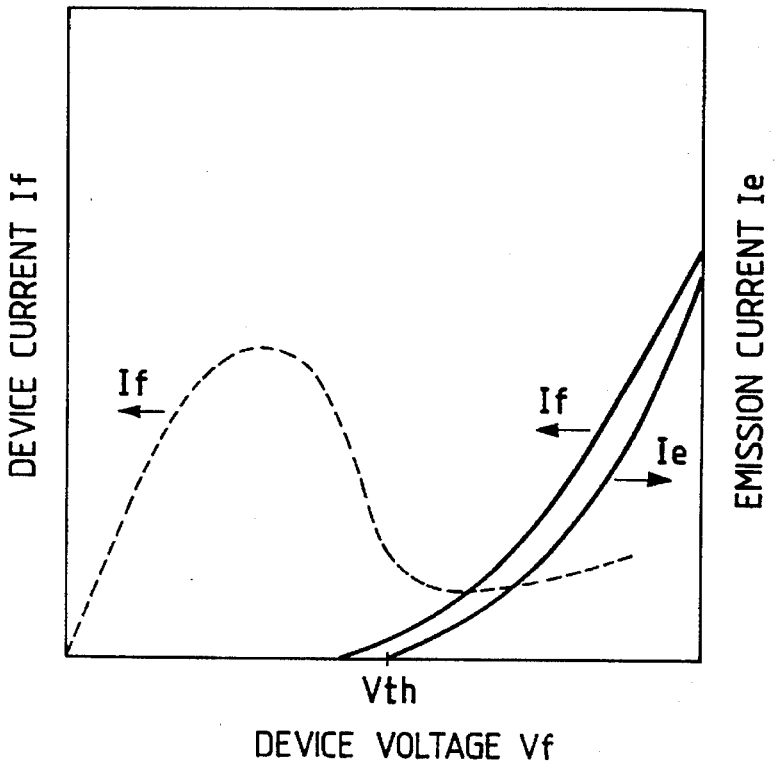
FIG. 4 is a graph showing the relationship between the device voltage and the device current as well as the relationship between the device voltage and the emission current of a surface conduction electron-emitting device manufactured by a method according to the invention.
Figure 5A:
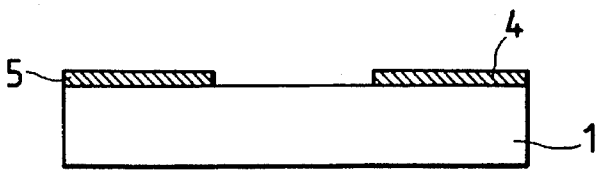
FIGS. 5A through 5F schematically show different steps of manufacturing an electron-emitting device used in a first mode of realizing the present invention.
Figure 5B:
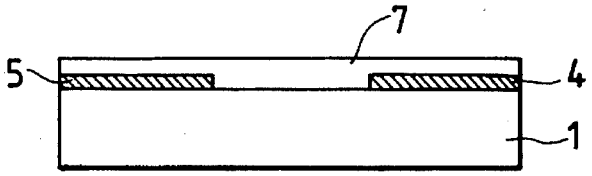
Figure 5C:
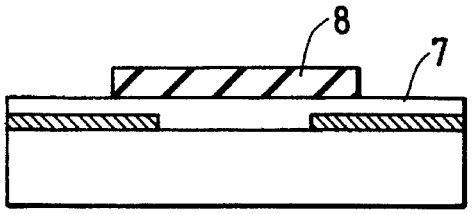
Figure 5D:
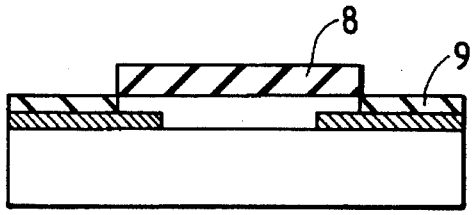
Figure 5E:
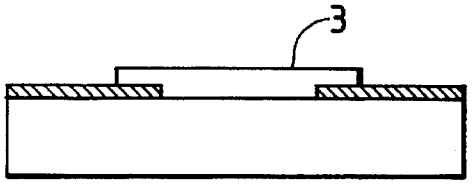
Figure 5F:
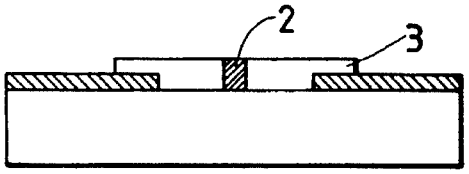

As seen in FIG. 4, a surface conduction electron-emitting device according to the invention has three remarkable features in terms of emission current Ie, which will be described below.

Firstly, an electron-emitting device of the type under consideration shows a sudden and sharp increase in the emission current Ie when the voltage applied thereto exceeds a certain level (which is referred to as a threshold voltage hereinafter and indicated by Vth in FIG. 4), whereas the emission current Ie is practically unobservable when the applied voltage is found lower than the threshold value Vth. Differently stated, an electron-emitting device of the above identified type is a non-linear device having a clear threshold voltage Vth relative to the emission current Ie.

Secondly, since the emission current Ie monotonically increases as a function of the device voltage Vf (a relationship which is referred to as MI characteristic hereinafter), the former can be effectively controlled by way of the latter.

Thirdly, the emitted electric charge captured by the anode 54 is a function of the duration of time of applying the device voltage Vf. In other words, the amount of electric charge captured by the anode 54 can be effectively controlled by way of the time during which the device voltage Vf is applied.

While the emission current If shows an MI characteristic relative to the device voltage Vf, the device current If may also show an MI characteristic relative to the device voltage Vf. These characteristic relationships of a surface conduction electron-emitting device are shown by solid lines in FIG. 4. On the other hand, the device may show a voltage-controlled negative resistance relationship (hereinafter referred to as VCNR characteristic) relative to the device voltage Vf as indicated by a broken line in FIG. 4. Which one of these relationships becomes apparent for a surface conduction electron-emitting device depends on the method selected for manufacturing the device and the parameters selected for the gauging system. However, it has been found that, if the device current If of a surface conduction electron-emitting device according to the invention shows a VCNR characteristic relative to the device voltage, the emission current of the device shows an MI characteristic relative to the device voltage Vf.

For the purpose of the present invention, the emission current Ie of a surface conduction electron-emitting device shows an MI characteristic relative to and, at the same time, is unequivocally determined by the device voltage Vf. Furthermore, for the purpose of the present invention, the emission current Ie and the device current If of a surface conduction electron-emitting device show an MI characteristic relative to and, at the same time, are unequivocally determined by the device voltage Vf.

For the purpose of the present invention, the expression that the emission current Ie is unequivocally determined as used herein means that, the Ie–Vf relationship observed when the emission current reaches a saturated level of Ie as the device voltage is applied to the device at a constant level of Vf is practically same as the Ie'–Vf' relationship observed when the emission current reaches another saturated level of Ie' as the device voltage is applied to the device at another constant level of Vf'.

A surface conduction electron-emitting device according to the invention and having an emission current Ie that is unequivocally determined can be subjected a stabilizing step after the electric forming step and the activation step.

In a stabilizing step, the surface conduction electron-emitting device that has been processed in the electric forming and activation steps is held in a vacuum condition having a level of vacuum higher than those used in the electric forming and activation steps and preferably driven to operate. More preferably, the device is heated to 80° C. to 150° C. in the vacuum before it is driven to operate.

For the purpose of the present invention, a vacuum condition having a level of vacuum higher than those used in the electric forming and activation steps refers to a level of vacuum typically higher than $10^{-6}$ Torr, preferably higher than $10^{-7}$ Torr and most preferably a level of ultrahigh vacuum higher than $10^{-8}$ Torr, where no carbon nor carbon compounds can be additionally deposited on the device.

As a surface conduction electron-emitting device is held in a vacuum chamber under a vacuum condition of the above described level, no carbon nor carbon compounds can be additionally deposited on the device so that the emission current Ie of the device is stabilized and unequivocally determined by the device voltage Vf. As a result of a stabilizing step, the emission current Ie of a surface conduction electron-emitting device shows an MI characteristic relative to and, at the same time, is unequivocally determined by the device voltage Vf. Since the device current If is also stabilized, both the emission current Ie and the device current If of the surface conduction electron-emitting device show an MI characteristic relative to and, at the same time, are unequivocally determined by the device voltage Vf.

[Mode 2]

A second preferred mode of realizing the present invention will be described.

In this mode, the step of forming an electroconductive film 3, out of which an electron-emitting region is to be formed, between a pair of oppositely disposed electrodes 4 and 5 comprises a step of decomposing an organic metal compound thin film through heat treatment and simultaneously chemically changing it through selective irradiation of ultraviolet rays in an oxidizing atmosphere to form a metal oxide thin film at a portion thereof where an electroconductive film including an electron-emitting region is to be formed and a metal thin film at the remaining portion thereof and a subsequent step of selectively removing the metal thin film by etching to produce an electroconductive thin film of a metal oxide.

Techniques that can be used to form a metal thin film and a metal oxide thin film through selective irradiation of ultraviolet rays for the purpose of the invention include one with which an organic metal compound thin film is formed and thereafter a portion thereof where an electroconductive thin film including an electron-emitting region is to be formed is irradiated with ultraviolet rays for pyrolysis in an oxidizing atmosphere at a temperature higher than the decomposition temperature of the organic metal compound and lower than the oxidation temperature of the compound so that the portion where an electroconductive film including an electron-emitting region is to be formed is turned into a metal oxide thin film whereas the remaining portion is turned into a metal film and one with which an organic metal compound thin film is turned into a metal thin film through pyrolysis and thereafter a desired portion of the metal film is irradiated with ultraviolet rays in an oxidizing atmosphere to produce a metal oxide film there.

Now, this mode will be described by referring to FIGS. 7A through 7F.

Figure 7A:
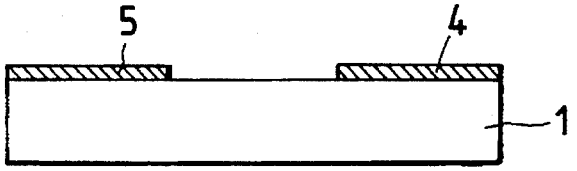
FIGS. 7A through 7F schematically show different steps of manufacturing an electron-emitting device used in second and third modes of realizing the present invention.

Step a: After thoroughly cleaning an insulating substrate 1, a pair of device electrodes 4 and 5 are formed on the substrate 1 by appropriate means such as a combination of vacuum deposition or sputtering and photolithography or printing (FIG. 7A).

Figure 7B:
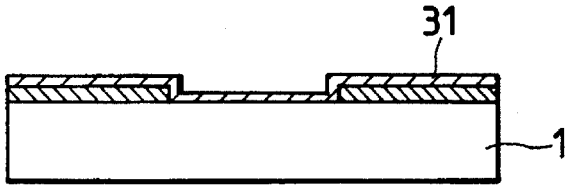

Step b: An organic metal compound film 31 is formed on the substrate 1 carrying thereon the device electrodes 4 and 5 by applying the compound (FIG. 7B).

Figure 7C:
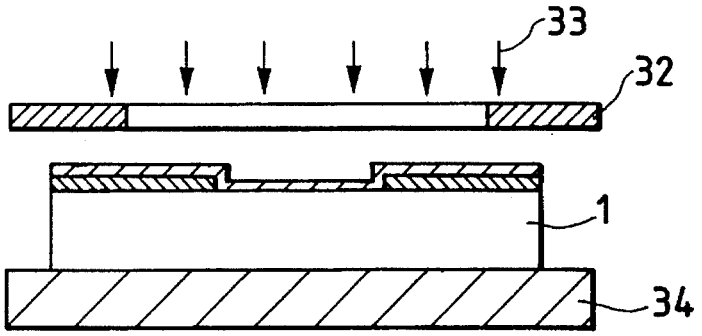

Step c: Only a portion of the organic metal compound film where an electroconductive thin film including an electron-emitting region is to be formed is irradiated with ultraviolet rays 33, using a photomask 32 for covering the remaining portion, at a temperature higher than the decomposition temperature of the organic metal compound and lower than the oxidation temperature of the compound in an oxidizing atmosphere (FIG. 7C). Reference numeral 34 denotes a heater.

Figure 7D:
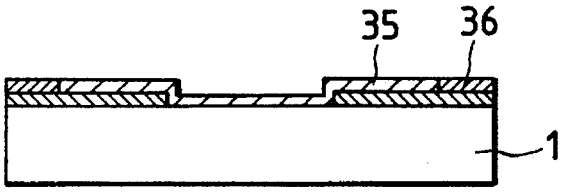

Step d: The portion irradiated with ultraviolet rays is oxidized at an accelerated rate to form a metal oxide thin film 35, whereas the remaining portion becomes a metal film 36 (FIG. 7D).

Figure 7E:
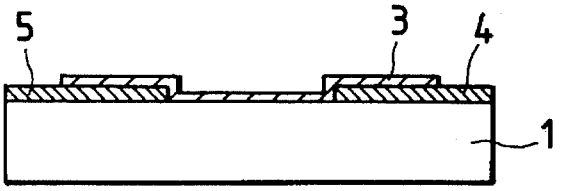

Step e: The metal film 36 is selectively etched to produce an electroconductive thin film 3, where an electron-emitting region is to be formed, utilizing the difference of chemical responsiveness between the metal film 36 and the metal oxide film 35 (FIG. 7E).

Figure 7F:
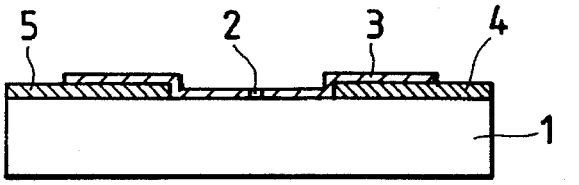

Step f: Subsequently, the electroconductive film 3 is subjected to an electric forming operation to produce an electron-emitting region 2 in the electroconductive film 3 as in the case of Mode 1 (FIG. 7F). Preferably, the device is subsequently subjected to an activation step.

Note that, in Step c above, the operation of partly turning the organic metal compound thin film into a metal thin film through pyrolysis and the operation of partly turning it into a metal oxide thin film through irradiation of ultraviolet rays can be carried out separately and sequentially.

[Mode 3]

A third mode of realizing the present invention will now be described.

In this mode, the step of forming an electroconductive film 3, out of which an electron-emitting region is to be formed, between a pair of oppositely disposed electrodes 4 and 5 comprises steps of forming an organic metal compound thin film, turning a portion of the organic metal compound thin film, where an electron-emitting region is to be formed, into a metal oxide film and the remaining portion thereof into a metal film by locally heating the former portion to a temperature higher than the oxidation temperature of the compound by means of an infrared lamp or laser and selectively removing the metal thin film by etching.

Now, this mode will be described by referring to FIGS. 7A through 7F as in the case of Mode 2 above because the two modes resembles each other.

Step a: After thoroughly cleaning an insulating substrate 1, a pair of device electrodes 4 and 5 are formed on the substrate 1 by means of a combined use of a film forming technique such as a vacuum deposition or sputtering and photolithography or printing (FIG. 7A).

Step b: An organic metal compound film 31 is formed on the substrate 1 carrying thereon the device electrodes 4 and 5 by applying the compound (FIG. 7B).

Step c: Only a portion of the organic metal compound film where an electroconductive thin film including an electron-emitting region is to be formed is heated to a temperature higher than the oxidation temperature of the organic metal compound by locally irradiating the portion with infrared rays 33 using a photomask 32 for covering the remaining portion, or scanning the portion with a laser beam without a mask (FIG. 7C).

Step d: The portion irradiated with infrared rays or laser is oxidized to form a metal oxide thin film 35, whereas the remaining portion becomes a metal film 36 (FIG. 7D).

Step e: The metal film 36 is selectively etched to produce an electroconductive thin film 3, where an electron-emitting region is to be formed, utilizing the difference of chemical responsiveness between the metal film 36 and the metal oxide film 35 (FIG. 7E).

Step f: Subsequently, the electroconductive film 3 is subjected to an electric forming operation to produce an electron-emitting region 2 in the electroconductive film 3 as in the case of Mode 1 (FIG. 7F).

Preferably, the device is subsequently subjected to an activation step.

Note that, all the organic metal compound formed in Step b above can alternatively be turned into a metal film under appropriate conditions and, subsequently, a desired portion of the metal film can be turned into a metal oxide film as in the case of Step c above.

[Mode 4]

A fourth mode of realizing the present invention will now be described.

In this mode, the step of forming an electroconductive film 3, out of which an electron-emitting region is to be formed, between a pair of oppositely disposed electrodes 4 and 5 comprises steps of forming an organic metal compound thin film, patterning the organic metal compound thin film to define a given area and forming an electron-emitting region in the patterned thin film and the step of patterning the organic metal compound thin film to define a given area by turn comprises steps of baking the given area of the organic metal compound thin film by irradiating it with thermal rays and removing the remaining area of the organic metal compound thin film by washing it with an organic solvent and keeping it to appropriate temperature to make it sublimate.

Now, this mode will be described by referring to FIGS. 8A through 8F illustrating different steps of manufacturing a device as shown in FIGS. 2A and 2B.

Figure 8A:
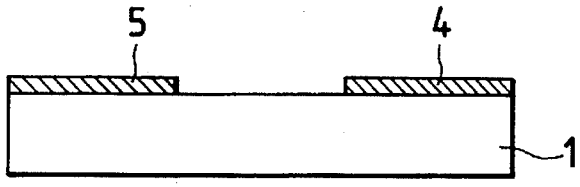
FIGS. 8A through 8F schematically show different steps of manufacturing an electron-emitting device used in fourth and fifth modes of realizing the present invention.

Step a: After thoroughly cleaning an insulating substrate 1 with a detergent, pure water and an organic solvent, a pair of device electrodes 4 and 5 are formed on the substrate 1 by means of a combined use of a film forming technique such as vacuum deposition or sputtering and photolithography or printing (FIG. 8A).

Figure 8B:
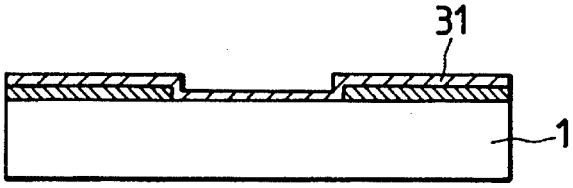

Step b: An organic metal compound film 31 is formed on the substrate 1 carrying thereon the device electrodes 4 and 5 by applying the compound and leaving it for a while (FIG. 8B).

Figure 8C:
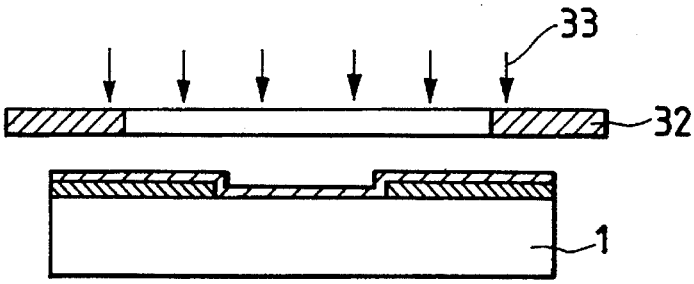

Step c: Only a portion of the organic metal compound film where an electroconductive thin film including an electron-emitting region is to be formed is covered by an exposure mask 32 having the profile of the thin film including an electron-emitting and only the covered portion of the film is heated and baked as it is irradiated with thermal rays 33 coming from a light source that is capable of irradiating thermal rays with a sufficient intensity. The intensity of thermal ray irradiation of the source is so controlled that the temperature of the organic metal compound film is heated to a temperature higher than the oxidation temperature of the metal that is the principal ingredient of the compound. Alternatively, the baking operation may be carried out on the desired portion by scanning the organic metal compound film with a laser beam in such a way that the beam is turned on and off in synchronism with the scanning motion of the beam moving into and out of the desired portion (FIG. 8C).

Figure 8D:
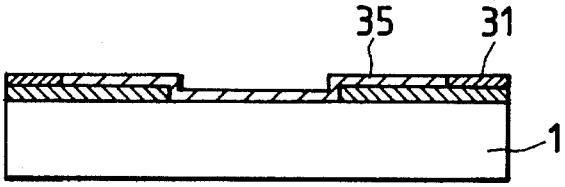

Step d: The portion irradiated with thermal rays makes a metal oxide thin film 35, whereas the remaining portion remains to be a organic metal compound film 31 (FIG. 8D).

Figure 8E:
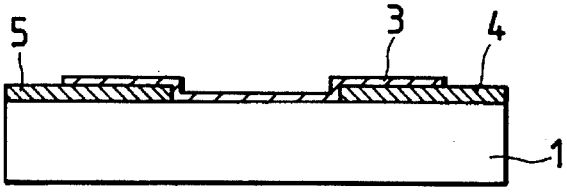

Step e: The remaining organic metal compound film 3 is removed to produce a thin film where an electron-emitting region is to be formed by washing the device with an organic solvent to remove the metal organic compound, or keeping it to an appropriate temperature higher than the sublimation temperature and lower than the decomposition temperature of the organic metal compound to make it sublimate (FIG. 8E).

Figure 8F:
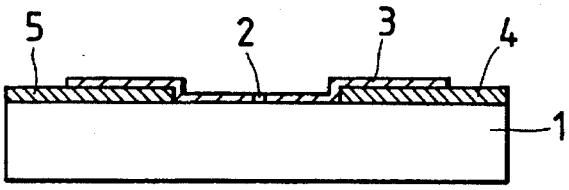

Step f: Subsequently, the electroconductive film 3 is subjected to an electric forming operation to produce an electron-emitting region 2 in the electroconductive film 3 as in the case of Mode 1 (FIG. 8F). Preferably, the device is subsequently subjected to an activation step.

[Mode 5]

A fifth mode of realizing the present invention will now be described.

While all the techniques that can be used in the fourth mode are also available in this mode, a near infrared ray absorbing organic metal composition is used for an organic metal compound thin film.

Then, a small laser device such as a semiconductor laser device can be used as a laser source so that the organic metal compound thin film can be heated efficiently. With this arrangement, the disadvantage of other related modes that thermal rays are not totally absorbed by a desired portion of the organic metal compound film and any remaining rays can heat the substrate to produce unnecessarily baked areas on the film can be effectively eliminated to ensure an accurate patterning operation.

For the purpose of the present invention, a near infrared ray absorbing organic metal composition can be prepared either by introducing a near infrared ray absorbing radical into each molecule of an organic metal compound to impart a property of absorbing near infrared rays to the latter or by mixing an organic metal compound and a near infrared ray absorbing compound.

Near infrared ray absorbing organic metal compositions that belong to the former category include, as illustrated in Chemical Formulas 1 through 11 below, phthalocyanine type metal complexes (1c, 1e, 1f, 2a and 2c), dithiol type metal complexes (3 through 6), mercaptonaphthol type metal complexes (7), polymethine type metal complexes (37 and 8 through 22), naphthoquinone metal complexes (complexes of 37 and 26 through 28), anthraquinone type metal complexes (complexes of 37 and 29 through 34), triphenylmethane type metal complexes (complexes of 37 and 35 and 36) and aminium diimmonium type metal complexes (complexes of 37 and 23 through 25).

Each near infrared ray absorbing organic metal composition belonging to the former category is prepared by mixing an organic metal compound or an organic complex compound and a near infrared ray absorbing coloring compound. Near infrared ray absorbing coloring compounds include phthalocyanine type coloring compounds (1a, 1b, 1d and 2b), polymethine type coloring compounds (8 through 22), naphthoquinone type coloring compounds (26 through 28), anthraquinone type coloring compounds (29 through 34), triphenylmethane type coloring compounds (35 and 36) and aminium diimmonium type coloring compounds.

Organic metal compounds that can be used for this mode include those having one or more than one metal-carbon bonds, metal salts of organic acids, alkoxydes and organic complex compounds that can produce a metal oxide if baked regardless of the metal contained in each compound. Example of compounds include metal salts of acetic acids (37) and acetylacetonato complexes. The mol ratio of an organic metal compound and a near infrared ray absorbing coloring compound that can be used for this mode is found between 20:1 to 1:2 and preferably between 20:1 to 5:5. If the near infrared ray absorbing coloring compound falls under the lower limit, the resultant composition does not satisfactorily absorb near infrared rays whereas, if it exceeds the upper limit, a disproportionally large amount of near infrared rays is required for the baking operation.

(1)

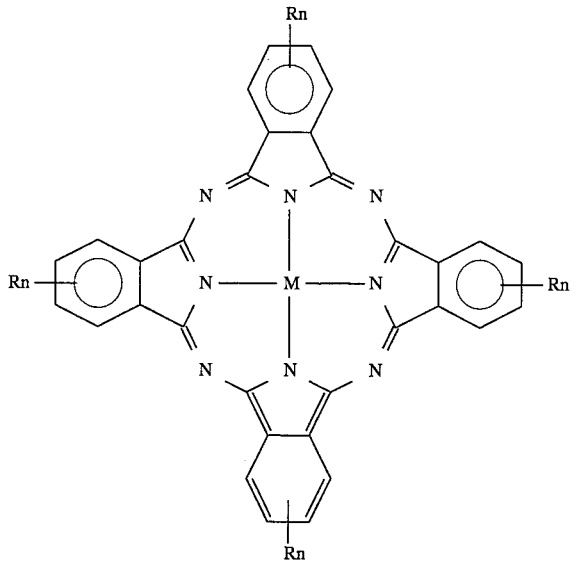

| | | |
|---|---|---|
| M = H | R = H | 1a |
| M = H | R = $C(CH_3)_3$ | 1b |
| M = Cu | R = $F_4$ | 1c |
| M = H | R = 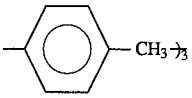 | 1d |
| M = Ti | R = H | 1e |
| M = Pb | R = H | 1f |

(2)

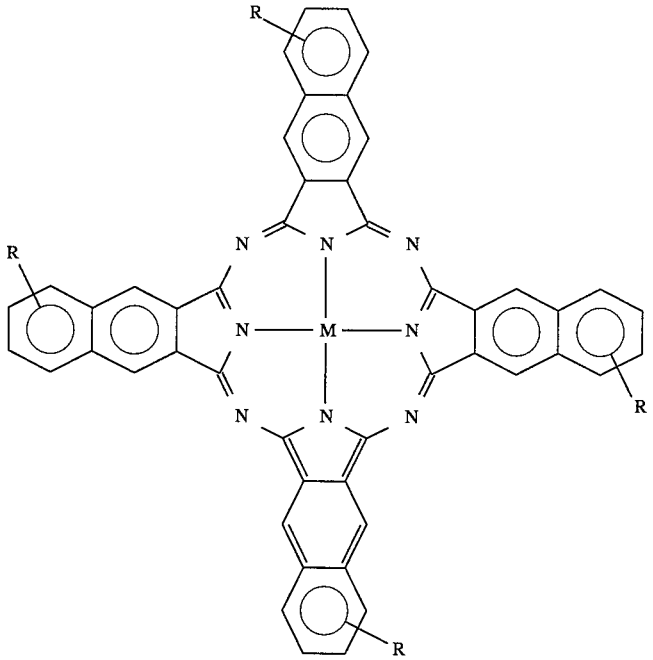

| | | |
|---|---|---|
| M = Zn | R = H | 2a |
| M = H | R = F | 2b |
| M = V | R = t-$C_5H_{11}$ | 2c |

-continued
(3)
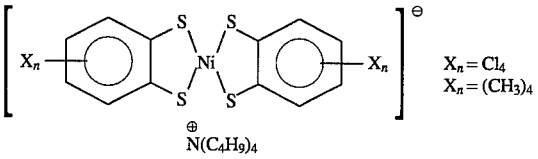
$X_n = Cl_4$
$X_n = (CH_3)_4$
(4)
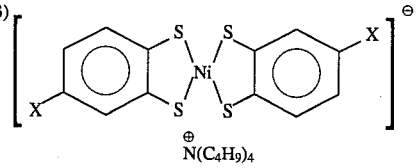
$X = N(CH_3)_2$
$X = CH_2—OH$
(5)
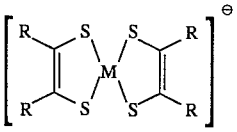
M = Ni R = $C_3H_7$
M = Ni R = 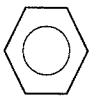
M = Ni R = CN
(6)
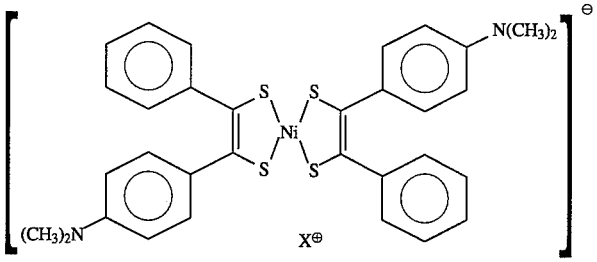
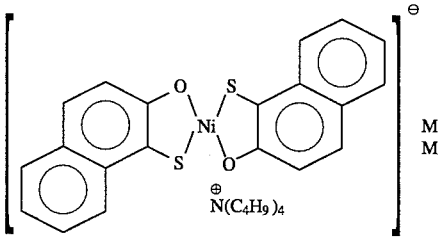
M = Ni
M = Co
(7)
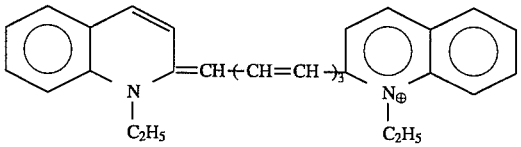
(8)
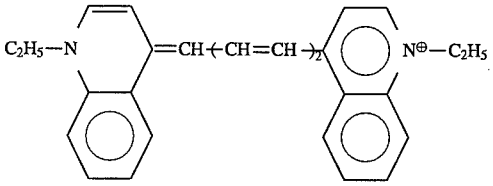
(9)
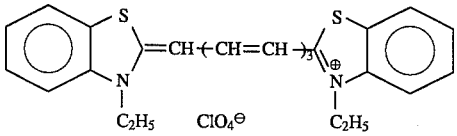
(10)
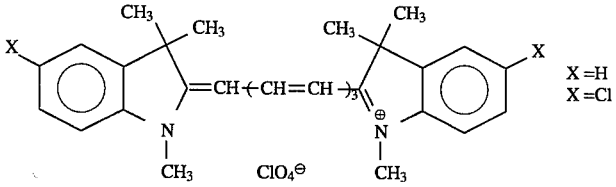
X = H
X = Cl
(11)
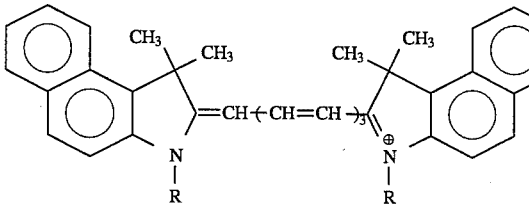
(12)
$R_1 = R_2 = CH_3$
$R_1 = (CH_2)_4SO_3Na$
$R_2 = (CH_2)_4SO_3^-$ -continued
(13)
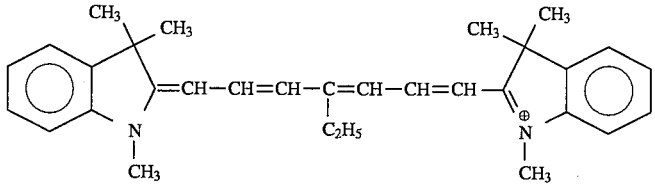
(14)
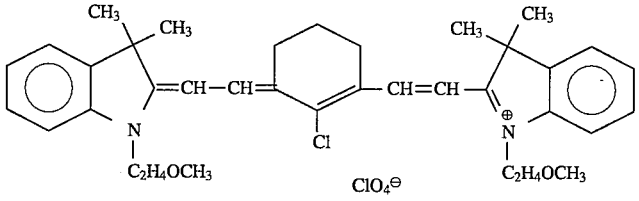
(15)
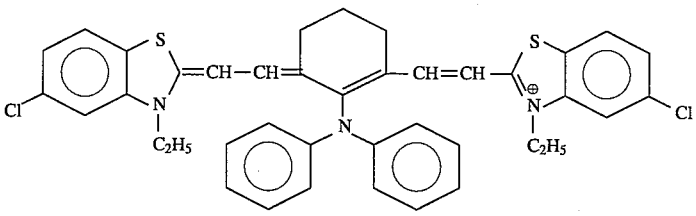
(16)
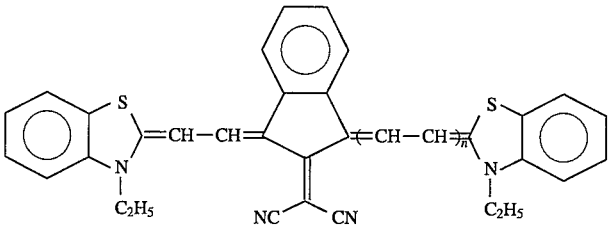
(17)
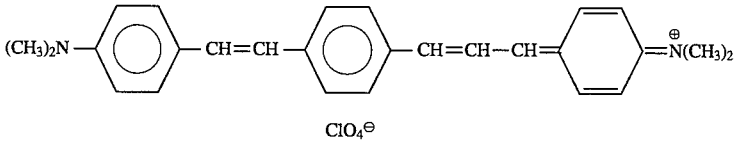
(18)
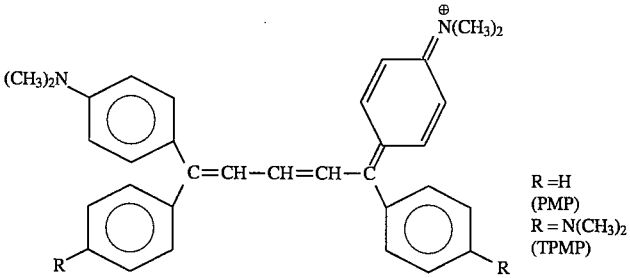
R =H
(PMP)
R = N(CH3)2
(TPMP)
(19)
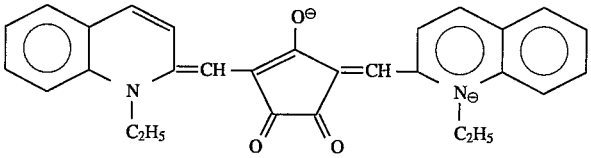
(20)
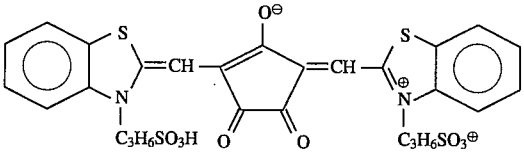
(21)
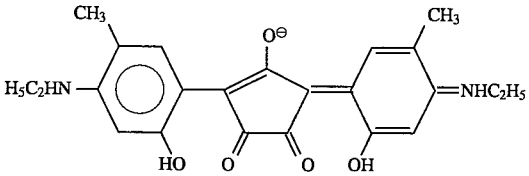

-continued
(22)
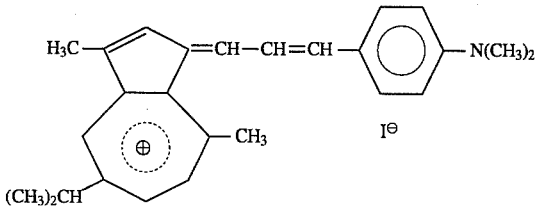
(23)
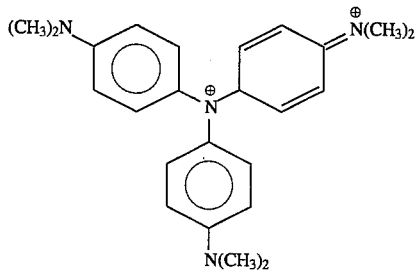
(24)
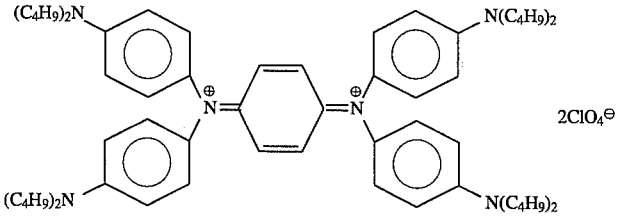
(25)
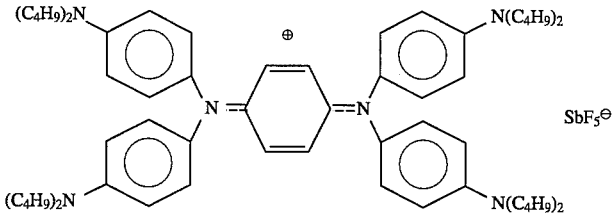
(26)
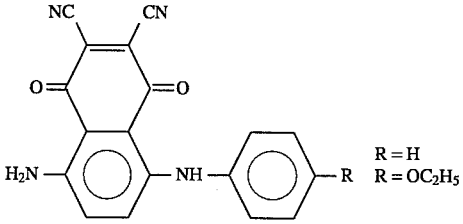
(27)
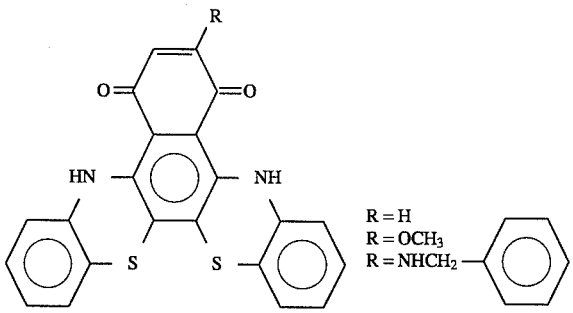
(28)
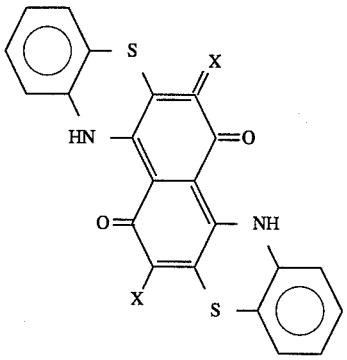
(29)
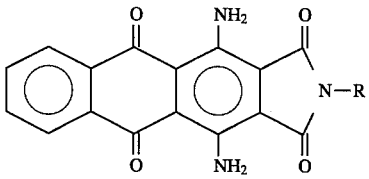

-continued
(30)
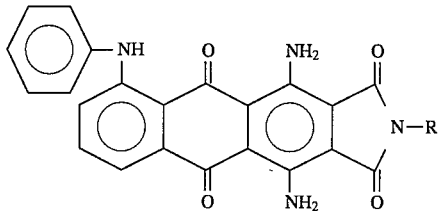
(31)
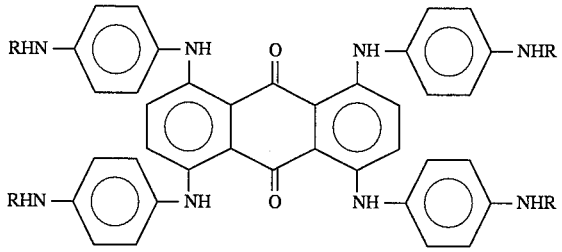
R = $(CH_2)_4COOCH_3$
(32)
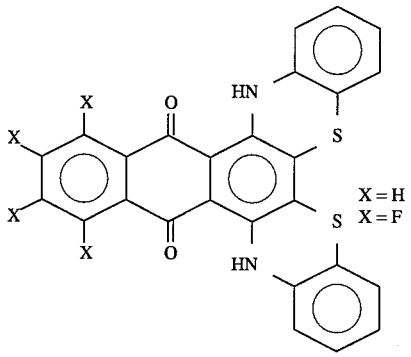
(33)
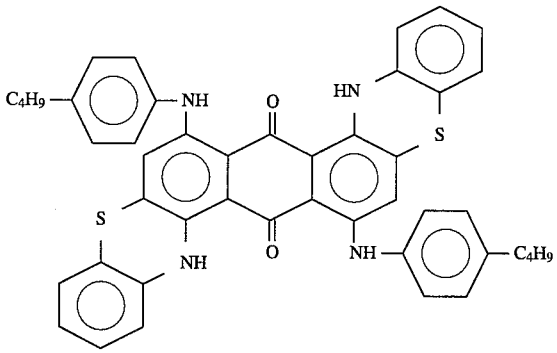
(34)
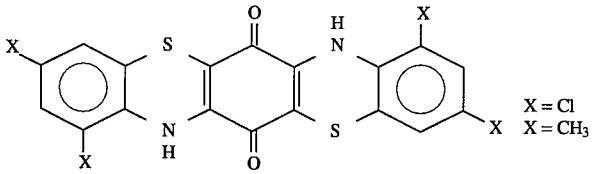
(35)
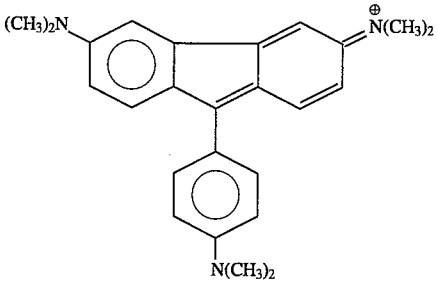

-continued

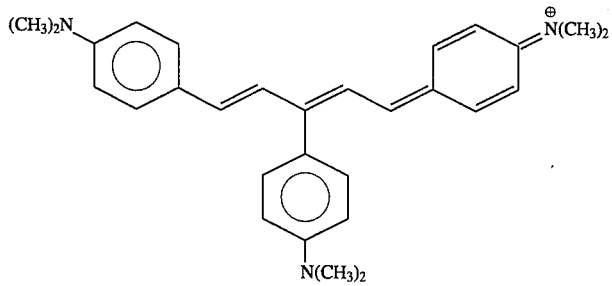

(36)

$M(OCOCH_3)_2$ M = Pd (37a)
M = Ni (37b)

(37)

$M(CH_3COCHCOCH_3)_2$ M = Pd (38a)
M = Ni (38b)
M = Pt (38c)

(38)

[Mode 6]

A sixth preferred mode of realizing the present invention will be described.

In this mode, the step of forming an electroconductive film 3, out of which an electron-emitting region is to be formed, between a pair of oppositely disposed electrodes 4 and 5 comprises steps of forming an organic metal compound thin film, decomposing a portion of the organic metal compound thin film to where an electroconductive thin film including an electron-emitting region is to be formed into the metal that is the principal ingredient of the organic metal compound and an organic component through irradiation of ultraviolet rays, removing the organic component of the portion and the organic metal compound of the remaining portion through sublimation while keeping the compound at a temperature higher than the sublimation temperature and lower than the decomposition temperature of the organic metal compound or immersion in an organic solvent to remove the organic metal compound and baking the remaining metal to produce an electroconductive thin film of a metal oxide, where an electron-emitting region is to be formed for the surface conduction electron-emitting.

Now, this mode will be described by referring to FIGS. 9A through 9F.

Figure 9A:
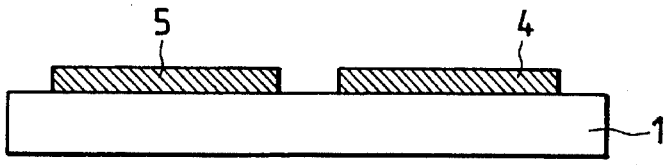
FIGS. 9A through 9F schematically show different steps of manufacturing an electron-emitting device used in a sixth mode of realizing the present invention.

Step a: A pair of device electrodes 4 and 5 are formed on a substrate 1 as in the case of Mode 1 (FIG. 9A).

Figure 9B:
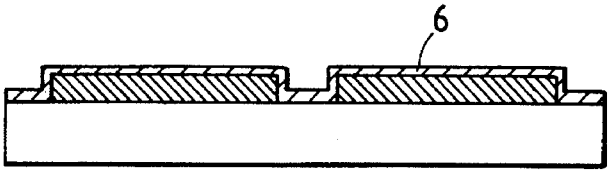

Step b: An organic metal compound film 6 is formed on the substrate 1 as in the case of Mode 1 (FIG. 9B).

Figure 9C:
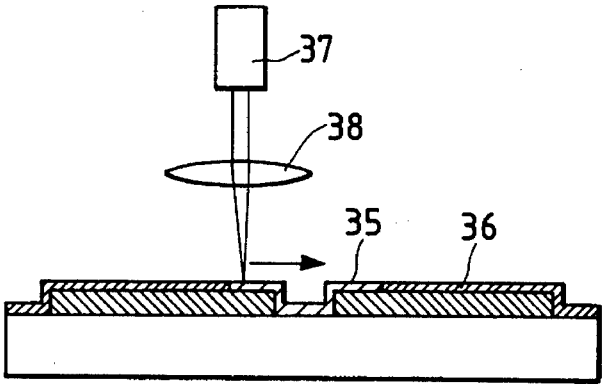
Figure 9D:
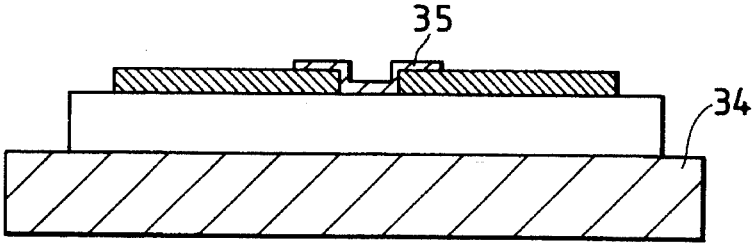

Step c: Only a portion 35 of the organic metal compound film 6 where an electroconductive thin film including an electron-emitting region is to be formed is irradiated with ultraviolet rays (FIG. 9C). More specifically, a beam emitted from an ultraviolet ray laser 37 is converged by an optical system 38 to scan the surface of the device in such a way that the beam is turned on and off in synchronism with the scanning motion of the beam moving into and out of the desired portion. Alternatively, only the desired portion may be irradiated with ultraviolet rays by using a mercury lamp and a photomask. Consequently, the organic metal compound of the desired portion is decomposed into the metal that is the principal ingredient of the compound and an organic component so that a chemical difference is generated between the portion that has been irradiated with ultraviolet rays and the remaining portion 36 that has not been irradiated with ultraviolet rays within the thin film on the substrate.

Step d: The organic metal compound of the portion that has not been irradiated with ultraviolet rays is removed through selective sublimation while keeping the device at a temperature higher than the sublimation temperature and lower than the decomposition temperature of the organic metal compound (FIG. 9D) using heater 34. As a result, the organic palladium compound of the portion that had not been irradiated with ultraviolet rays was caused to sublimate and disappear from the substrate, whereas the organic component of the portion that had been irradiated with ultraviolet rays was also removed, while the palladium of that portion was left on the substrate. Alternatively, the remaining organic metal compound and the organic component may be removed by immersing the device in an organic solvent to leave the portion 35 remaining on the substrate so that an electroconductive thin film including an electron-emitting region can be formed out of it.

Figure 9E:
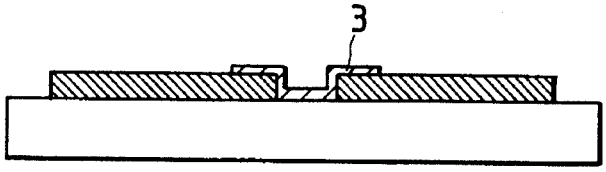

Step e: The metal on the substrate is heated by means of a heater 34 to a temperature higher than the oxidation temperature of the metal for baking. Consequently, an electroconductive thin film 3 of a metal oxide, where an electron-emitting region is to be formed, is produced on the substrate (FIG. 9E).

Figure 9F:
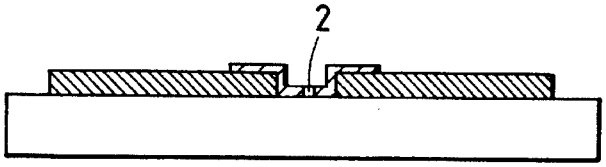

Step f: Subsequently, the electroconductive film 3 is subjected to an electric forming operation to produce an electron-emitting region 2 in the electroconductive film 3 as in the case of Mode 1 (FIG. 9F). Preferably, the device is subsequently subjected to an activation step.

[Mode 7]

This mode of realizing the present invention relates to a method of manufacturing an image-forming apparatus comprising an electron source realized by arranging a plurality of electron-emitting devices of the above described type on a substrate.

Figure 10:
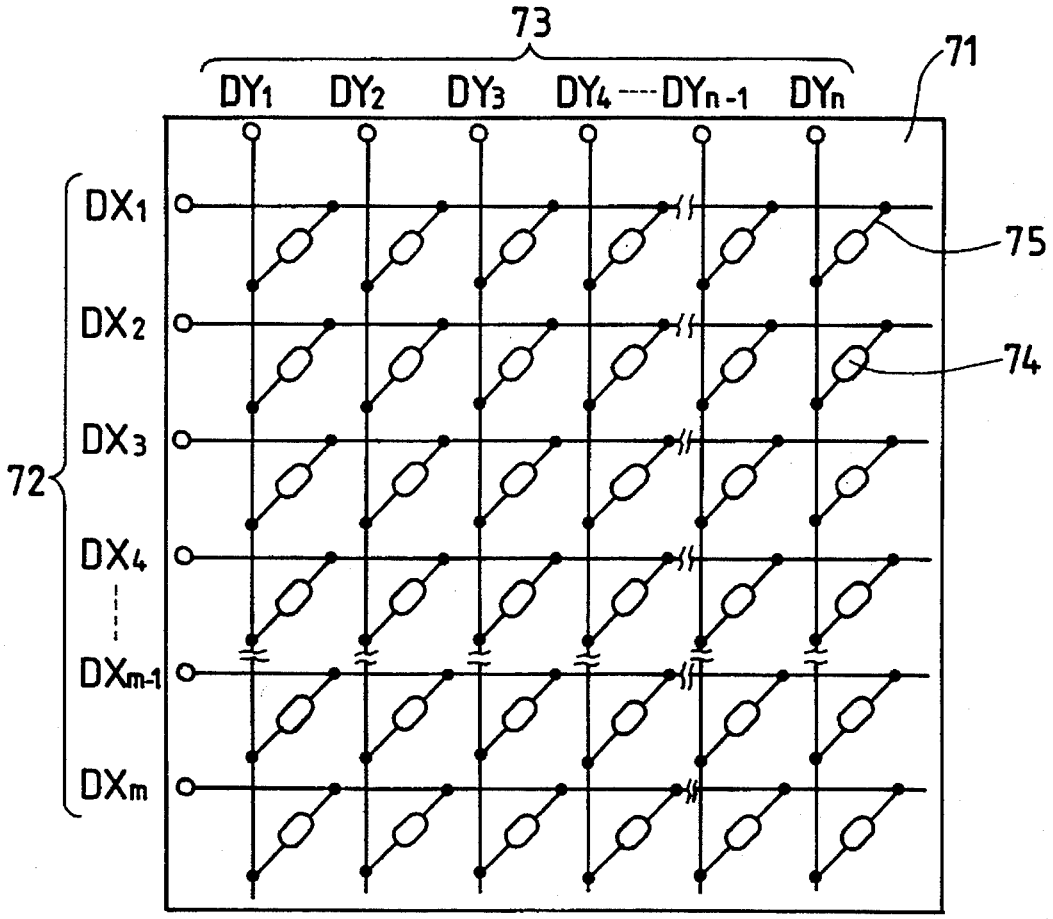
FIG. 10 is a schematic plan view of an electron source realized by arranging a large number of surface conduction electron-emitting devices manufactured by a method according to the invention, showing in particular the matrix arrangement of wirings and substrates.

FIG. 10 is a schematic plan view of an electron source realized for an image-forming apparatus by arranging a number of electron-emitting devices manufactured by a method according to the invention and arranged into a simple matrix. In FIG. 10, the electron source comprises an insulating substrate 71 such as a glass substrate, whose dimensions including the height are determined as a function of the number and profile of the electron-emitting devices arranged thereon and, if the electron source constitutes part of a container in operation, of the requirements that need to be met in order to keep the inside of the container under a vacuum condition.

There are provided on the insulating substrate 71 a total of m X-directional wirings 72, which are denoted by DX1, DX2, . . . , DXm and made of a conductive metal formed by vacuum deposition, printing or sputtering. These wirings are so designed in terms of material, thickness and width that a substantially equal voltage may be applied to the electron-emitting devices. A total of n Y-directional wirings 73 denoted by DY1, DY2, . . . , DYn are also provided. They are made of a conductive metal also formed by vacuum deposition, printing or sputtering and so similar to the X-directional wirings in terms of material, thickness and width that a substantially equal voltage may be applied to the electron-emitting devices. An interlayer insulation layer (not shown) is disposed between the m X-directional wirings and the n Y-directional wirings to electrically isolate them from each other, the m X-directional wirings and n Y-directional wirings forming a matrix. Note that m and n are integers. The interlayer insulation layer (not shown) is typically made of $SiO_2$ and formed by vacuum deposition, printing or sputtering.

The oppositely arranged device electrodes (not shown) of each of the electron-emitting devices 74 are electrically connected to the related ones of the m X-directional wirings 72 and the n Y-directional wirings 73 by respective connecting wires 75 which are also made of a conductive metal and formed by vacuum deposition, printing or sputtering.

The electron-emitting devices 74 are simultaneously formed on the insulating substrate 71 by a manufacturing method according to the invention in such a way that their thin films including respective electron-emitting regions show a predetermined pattern.

The X-directional wirings 72 are electrically connected to a scan signal generating means (not shown) for applying a scan signal to a selected row of electron-emitting devices 74 to scan the devices of the row.

On the other hand, the Y-directional wiring 73 are electrically connected to a modulation signal generating means (not shown) for applying a modulation signal to a selected column of electron-emitting devices 74 and modulating the devices of the column.

Note that the drive signal to be applied to each electron-emitting device is expressed as the voltage difference of the scan signal and the modulation signal applied to the device. Also note that, while the above described electron source is realized in the form of a simple matrix of electron-emitting devices, it may alternatively be realized in many different ways. For example, a ladder-like arrangement where electron-emitting devices are disposed between any two adjacent ones of a number of wirings disposed in parallel may provide a possible alternative.

Figure 11:
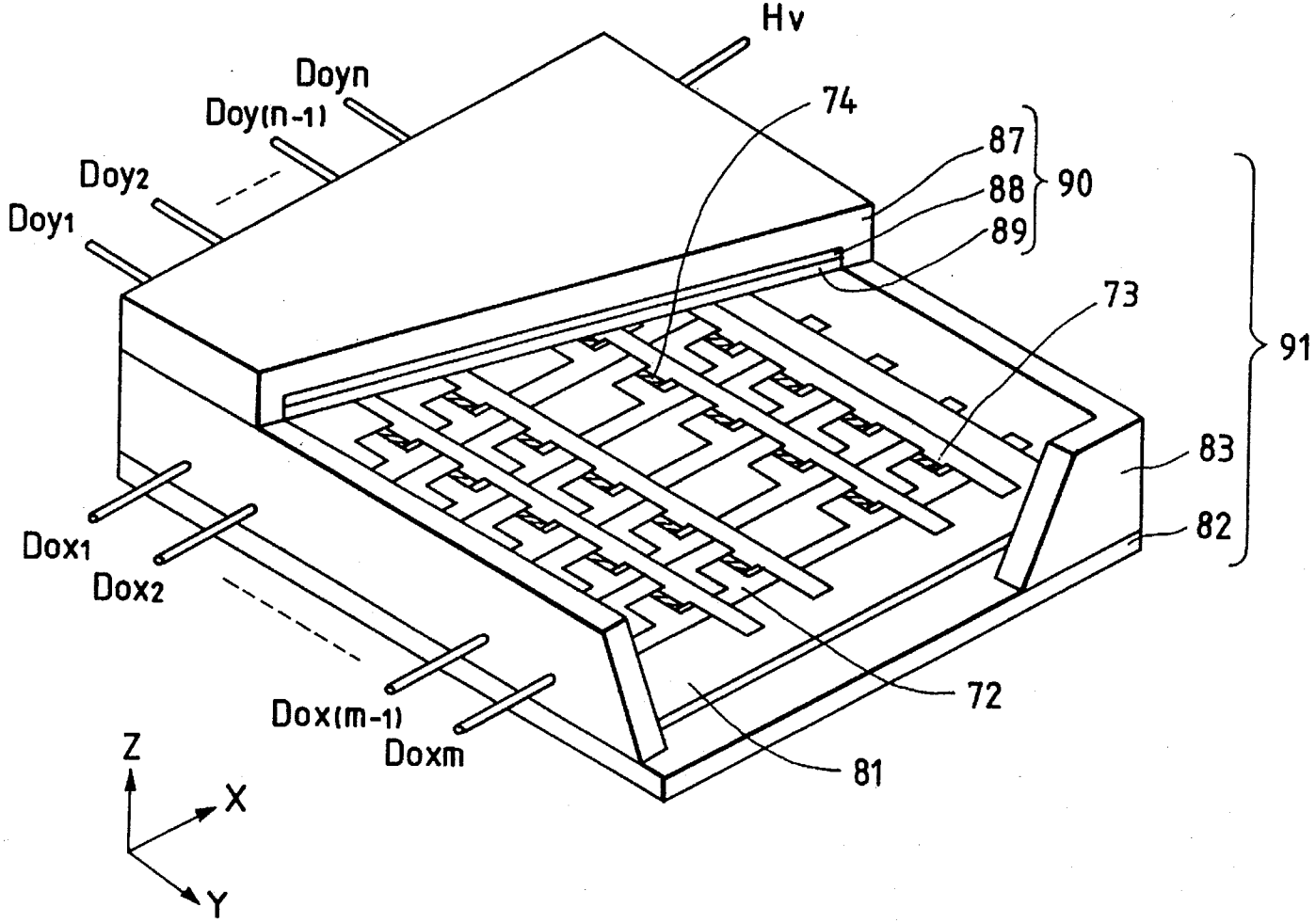
FIG. 11 is a partially cutaway schematic perspective view of an image-forming apparatus manufactured by a method according to the invention and comprising an enclosure and other components.

Now, an image-forming apparatus according to the invention and comprising an electron source prepared by arranging a plurality of electron-emitting devices in a simple matrix arrangement as described above will be described by referring to FIGS. 11, 12A and 12B, of which FIG. 11 illustrates the basic configuration of the image-forming apparatus and FIGS. 12A and 12B show two alternative patterns of fluorescent film that can be used for the image-forming apparatus. Referring firstly to FIG. 11, the image-forming apparatus comprises an electron source substrate 81 of the above described type carrying thereon a number of electron-emitting devices that have not been subjected to an electric forming operation, a rear plate 82 rigidly holding the electron source 81, a face plate 90 produced by laying a fluorescent film 88 and a metal back 89 on the inner surface of a glass substrate 87 and a support frame 83. An enclosure 91 is formed for the apparatus by assembling said rear plate 82, said support frame 83 and said face plate 90 and bonding them together with frit glass.

While the enclosure 91 is formed of a face plate 90, a support frame 83 and a rear plate 82 in the above description, the rear plate 82 may be omitted if the electron source 81 is strong enough by itself because the rear plate 82 is used mainly to reinforce the strength of the electron source 81. If such is the case, an independent rear plate 82 may not be required and the electron source 81 may be directly bonded to the support frame 83 so that the enclosure 91 is constituted of a face plate 90, a support frame 83 and an electron source 81.

Figure 12A:
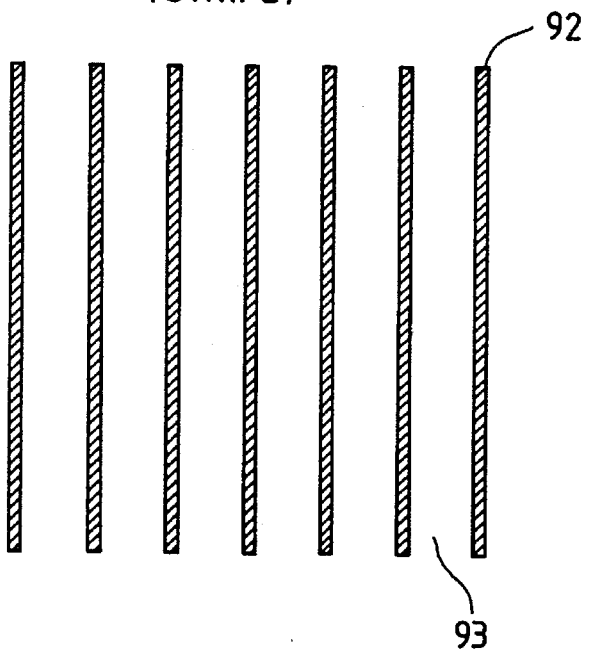
FIGS. 12A and 12B are schematic partial views of two possible alternative fluorescent films that can be used for an image-forming apparatus to be manufactured by a method according to the invention.
Figure 12B:
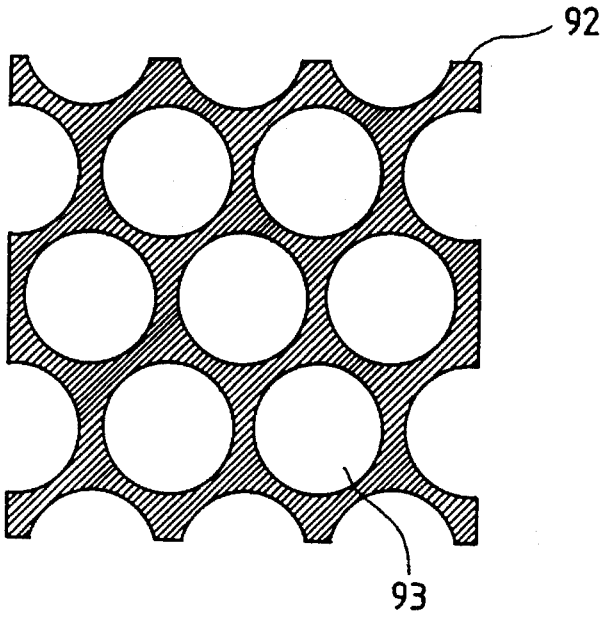
Figure 13A:
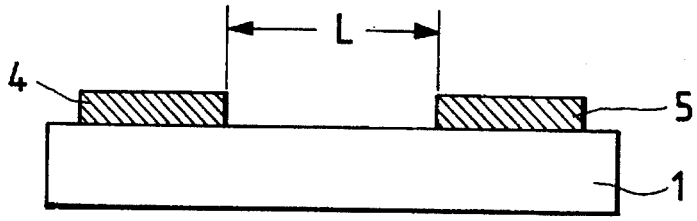
FIGS. 13A through 13E schematically show different steps of manufacturing an electron-emitting device that can alternatively be used in the fifth mode of realizing the present invention and were actually used for Examples 10, 11 and 12, which will be described hereinafter.
Figure 13B:
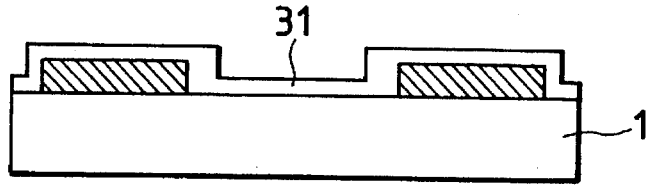
Figure 13C:
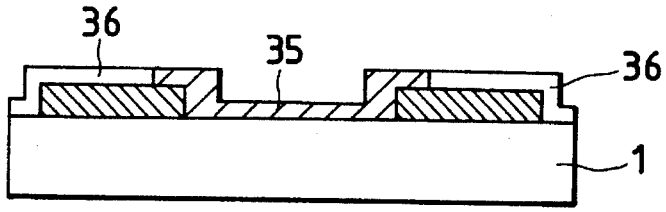
Figure 13D:
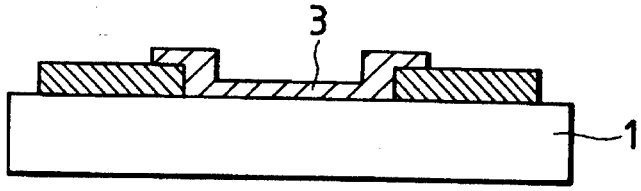
Figure 13E:
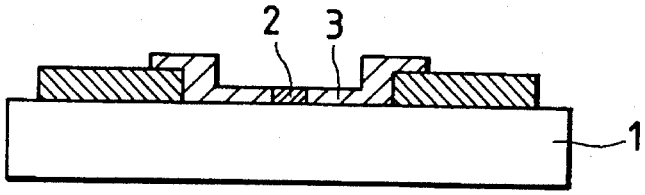

The fluorescent film 88 is made exclusively from phosphor if the apparatus is for displaying images in black and white, whereas it is made from phosphor 93 and a black conductive material 92 which may be referred to as black stripes or black matrix depending on the arrangement of fluorescent members of the film 88 made of phosphor as shown in FIGS. 12A and 12B if the apparatus is for displaying color images. Black stripes or members of a black matrix are arranged for a color display panel so that the blurring of the fluorescent substances 93 of three different primary colors is made less recognizable and the adverse effect of reducing the contrast of displayed images of external light on the fluorescent film 88 is weakened by blackening the surrounding areas. While graphite is normally used as a principal ingredient of the black stripes, other conductive material having low light transmissivity and reflectivity may alternatively be used.

A precipitation or printing technique can suitably be used for applying phosphor on the glass substrate 87 regardless of black and white or color display.

An ordinary metal back 89 is arranged on the inner surface of the fluorescent film 88. The metal back 89 is provided in order to enhance the luminance of the display panel by causing the rays of light emitted from the fluorescent bodies and directed to the inside of the enclosure to be fully reflected toward the face plate 90, to use it as an electrode for applying an accelerating voltage to electron beams and to protect the phosphor against damages that may be caused when negative ions generated inside the enclosure collide with it. The metal back is prepared by smoothing the inner surface of the fluorescent film 88 (in an operation normally referred to as "filming") and forming an Al film thereon by vacuum deposition in a manufacturing step subsequent to the preparation of the fluorescent film. A transparent electrode (not shown) may be formed on the face plate 90 facing the outer surface of the fluorescent film 88 in order to raise the electroconductivity of the fluorescent film 88.

Care should be taken to accurately align each set of pieces of phosphorous materials of the primary colors and a corresponding electron-emitting device, if a color display is involved, before the above listed components of the enclosure are bonded together.

The enclosure 91 is then evacuated by way of an exhaust pipe (not shown). Thereafter, the electron-emitting devices are subjected to an electric forming step and a subsequent activation step, where a voltage is applied to the opposite electrodes of the device by way of terminals Doxl through Doxm and Doyl through Doyn that are external to the enclosure in order to carry out an electric forming operation and a subsequent operation of activation.

The devices may thereafter be subjected to a stabilization step, where the devices are driven to operate while the enclosure 91 is being evacuated by means of an oil-free exhaust system and heated to 80° C. to 150° C. With this operation, any additional deposition of carbon and/or carbon compounds is suppressed to stabilize the emission current Ie of each device so that the emission current Ie is unequivocally determined relative to the device voltage Vf. Additionally, the device current If also comes to show an MI characteristic relative to Vf and hence can be substantially unequivocally determined relative to Vf.

The enclosure 91 is hermetically sealed. A getter operation may be carried out after sealing the enclosure 91 in order to maintain a high degree of vacuum in it. A getter operation is an operation of heating a getter (not shown) arranged at a given location in the enclosure 91 immediately before or after sealing the enclosure 91 by resistance heating or high frequency heating to produce a vapor deposition film. A getter normally contains Ba as a principal ingredient and the formed vapor deposition film can typically maintain the inside of the enclosure typically to a degree of $1\times10^{-7}$ Torr by its adsorption effect.

An image-forming apparatus according to the invention and having a configuration as described above is operated by applying a voltage to each electron-emitting device by way of the external terminals Doxl through Doxm and Doyl through Doyn to cause the electron-emitting devices to emit electrons. Meanwhile, a high voltage of greater than several kV is applied to the metal back 89 or the transparent electrode (not shown) by way of a high voltage terminal Hv to accelerate electron beams and cause them to collide with the fluorescent film 88, which by turn is energized to emit light to display intended images.

While the configuration of a display panel to be suitably used for an image-forming apparatus according to the invention is outlined above in terms of indispensable components thereof, the materials of the components are not limited to those described above and other materials may appropriately be used depending on the application of the apparatus.

While the basic idea of the present invention is utilized to provide an image-forming apparatus for display applications in the above description, the electron source of such an image-forming apparatus can also be used as an alternative source of fluorescent light that can replace the light emitting diodes of an optical printer comprising a photosensitive drum and light emitting diodes as principal components. In such alternative applications, it may be used not only as a linear light source but also as a two-dimensional light source by selecting appropriate wirings out of the m X-directional and n Y-directional wirings.

[Mode 8]

In this mode of realizing the present invention, an electron source comprising a plurality of surface conduction electron-emitting devices arranged in a ladder-like manner on a substrate and an image-forming apparatus comprising such an electron source are manufactured. This mode will be described by referring to FIGS. 18 and 19.

Figure 18:
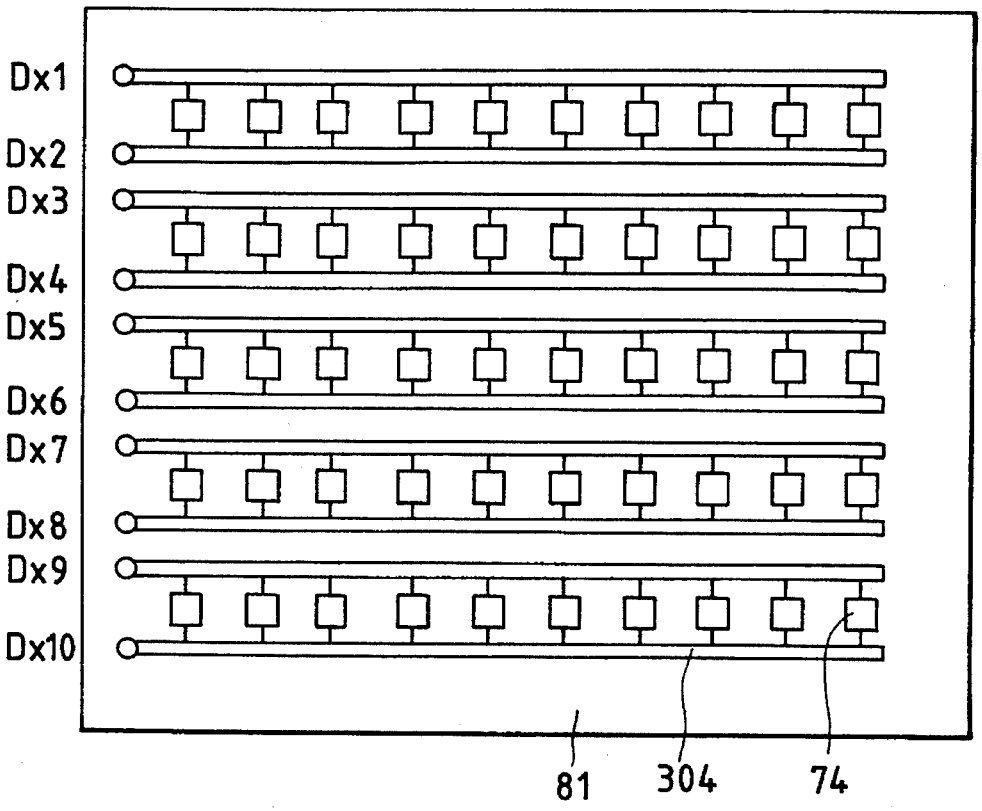
FIG. 18 is a schematic plan view of the wiring of an electron source to be manufactured by a method according to the invention, said electron source having a ladder-like arrangement of electron-emitting devices.

Firstly referring to FIG. 18, reference numeral 81 denotes an electron source substrate and reference numeral 74 denotes an surface conduction electron-emitting device arranged on the substrate, whereas reference numeral 304 denotes common wirings for connecting the surface conduction electron-emitting devices. There are a total of ten common wires that are provided with respective external terminals Dx1 through Dx10.

Surface conduction electron-emitting devices 74 are arranged in parallel columns, the number of columns in FIG. 18 being ten.

The surface conduction electron-emitting devices of each device column are electrically connected in parallel with each other by a pair of common wirings 304 (for instance, the devices of the first device column are connected in parallel with each other by the common wirings 304 of the external terminals Dx1 and Dx2) so that they can be driven independently by applying an appropriate drive voltage to the pair of common wirings. More specifically, a voltage exceeding the electron-emission threshold level is applied to the device columns to be driven to emit electrons, whereas a voltage below the electron-emission threshold level is allied to the remaining device columns. Alternatively, any two external terminals arranged between two adjacent device columns can share a single common wiring. Thus, pairs of external terminals Dx2 and Dx3, Dx4 and Dx5, Dx6 and Dx7, Dx8 and Dx9 can share a single common wiring instead of having exclusive common wirings.

Figure 19:
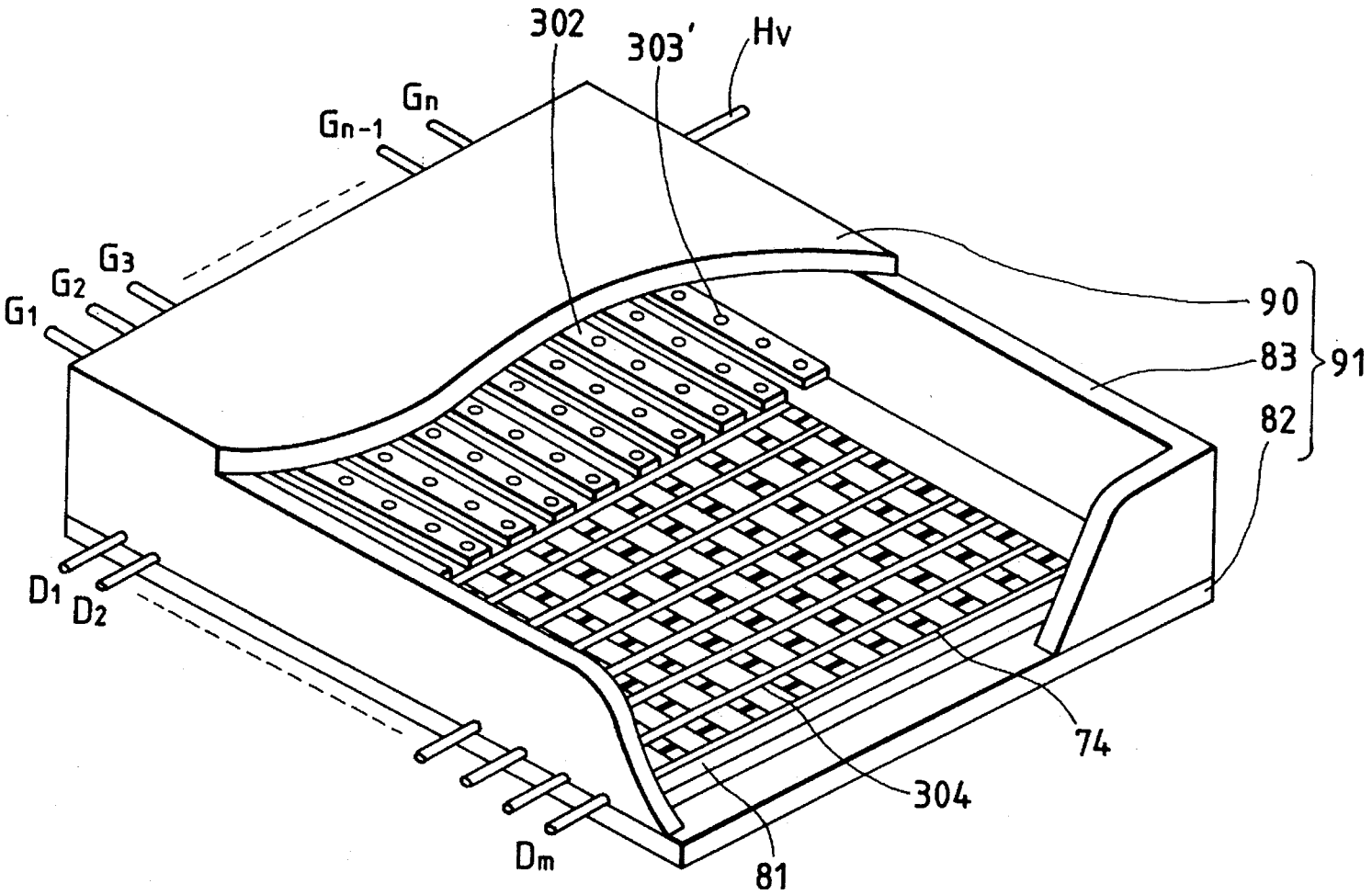
FIG. 19 is a partially cutaway schematic perspective view of an image-forming apparatus to be manufactured by a method according to the invention, said apparatus comprising an electron source having a ladder-like arrangement of electron devices.
Figure 20A:
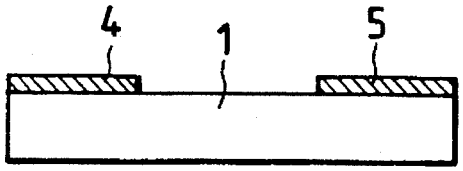
FIG. 20A PRIOR ART
FIGS. 20A through 20K schematically show different steps of manufacturing an electron-emitting device by a conventional method involving a lift-off technique.
Figure 20B:
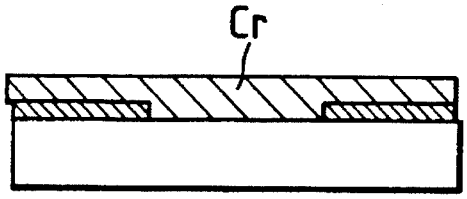
FIG. 20B PRIOR ART
Figure 20C:
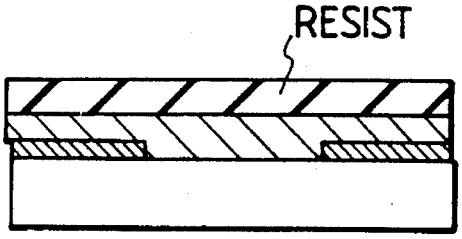
FIG. 20C PRIOR ART
Figure 20D:
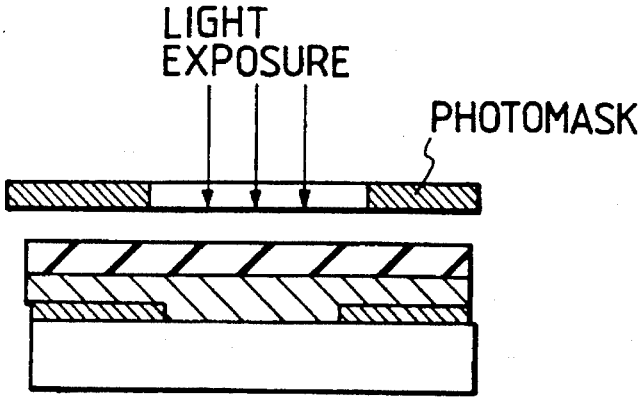
FIG. 20D PRIOR ART
Figure 20E:
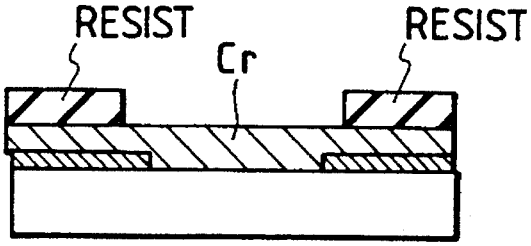
FIG. 20E PRIOR ART
Figure 20F:
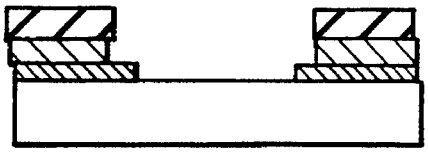
FIG. 20F PRIOR ART
Figure 20G:
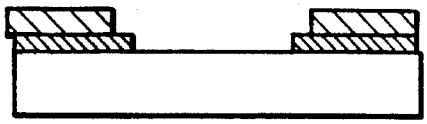
FIG. 20G PRIOR ART
Figure 20H:
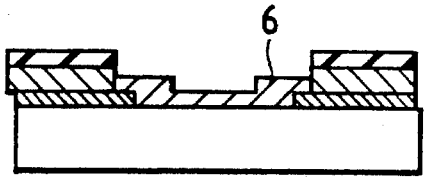
FIG. 20H PRIOR ART
Figure 20I:
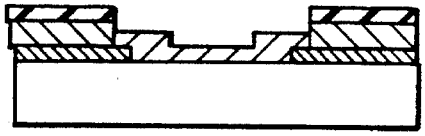
FIG. 20I PRIOR ART
Figure 20J:
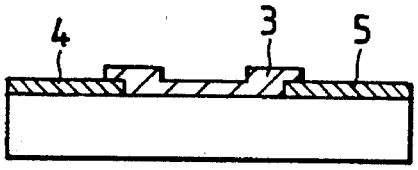
FIG. 20J PRIOR ART
Figure 20K:
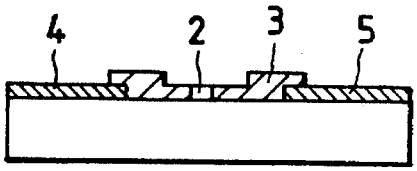
FIG. 20K PRIOR ART
Figure 21A:
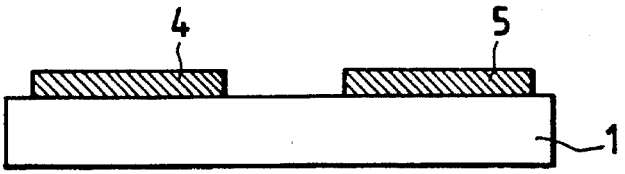
FIG. 21A PRIOR ART
FIGS. 21A through 21F schematically show different steps of manufacturing an electron-emitting device by a conventional method involving an etching technique.
Figure 21B:
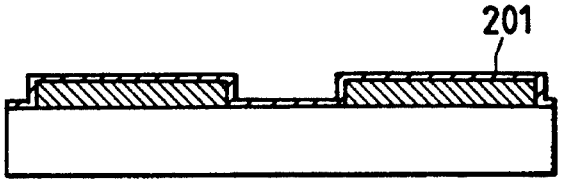
FIG. 21B PRIOR ART
Figure 21C:
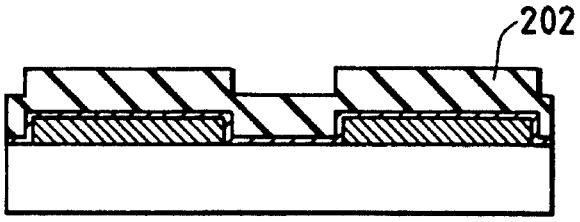
FIG. 21C PRIOR ART
Figure 21D:
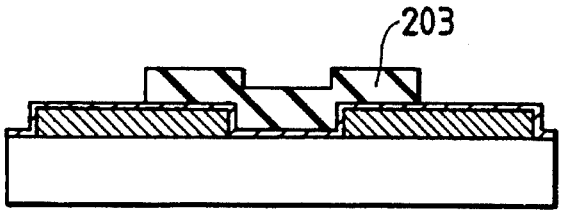
FIG. 21D PRIOR ART
Figure 21E:
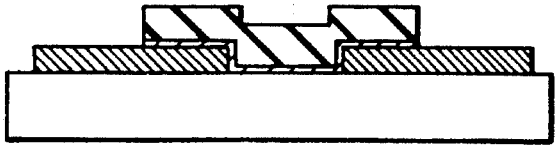
FIG. 21E PRIOR ART
Figure 21F:
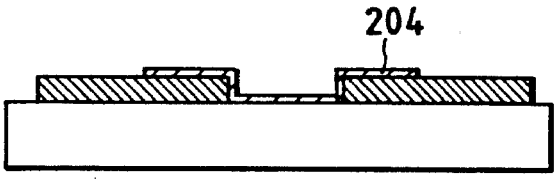
FIG. 21F PRIOR ART

FIG. 19 is a schematic perspective view of the display panel of an image-forming apparatus according to the invention incorporating an electron source having a ladder-like arrangement of electron-emitting devices. In FIG. 19, the display panel comprises grid electrodes 302, each provided with a number of through bores 303 for allowing electrons to pass therethrough, external terminals D1 through Dm and external terminals G1 through Gn connected to the respective grid electrodes 302. Note that only a single common wiring 302 is arranged between any two adjacent device columns on the substrate 1.

Also note that the same components are respectively denoted by the same reference symbols throughout FIGS. 11 and 19. The display panel of FIG. 19 remarkably differs from that of the image-forming apparatus of FIG. 11 having a simple matrix arrangement in that it additionally comprises grid electrodes 302 arranged between the electron source substrate 81 and the face plate 90.

As described above, strip-shaped grid electrodes 302 are arranged between the substrate 81 and the face plate 90 in FIG. 19. These grid electrodes 302 can modulate electron beams emitted from the surface conduction electron-emitting devices 74 and are provided with circular through bores 303 that are as many as the electron-emitting devices 74 to make one-to-one correspondence and allow electron beams to pass therethrough.

However, the profile and the location of the grid electrodes 302 are not limited to those of FIG. 19 and may be modified appropriately such that they are arranged near or around the electron-emitting devices 74. Likewise, the through bores 303 may be replaced by meshes or the like.

The external terminals D1 through Dm and the external terminals for the grids G1 through Gn are electrically connected to a control circuit (not shown). An image-forming apparatus having a configuration as described above can drive the fluorescent film for electron beam irradiation by simultaneously applying modulation signals to the columns of grid electrodes for a single line of an image in synchronism with the operation of driving (scanning) the electron-emitting devices on a row by row basis so that the image can be displayed on a line by line basis.

Now, the present invention will be described further by way of examples.

EXAMPLE 1

In this example, several specimens of surface conduction electron-emitting device having a configuration as shown in FIGS. 2A and 2B were prepared in Mode 1 described above. FIGS. 2A and 2B respectively show a schematic plan view and a schematic sectional view of a surface conduction electron-emitting of the type of this example. In FIGS. 2A and 2B, W denotes the width of thin film 3 including an electron-emitting region and L denotes the distance separating a pair of device electrodes 4 and 5, whereas W1 and d respectively denote the width and the height of the device electrodes.

The specimens were prepared by following the steps as described below by referring to FIGS. 5A through 5F, which correspond to Steps a through f respectively.

Step a: A quartz plate was used for the substrate 1 of each specimen. After thoroughly cleaning the plate with an organic solvent, a pattern of photoresist (RD-2000N-41: available from Hitachi Chemical Co., Ltd.) having openings of a desired profile for a pair of device electrodes was formed on the substrate 1 and then Ti and Pt were sequentially deposited thereon respectively to thicknesses of 50 Å and 1,000 Å by vacuum deposition. Thereafter, the photoresist pattern was treated by using a lift-off technique to produce a pair of device electrodes 5 and 6 having a width W1 of 300 μm and separated from each other by other by a distance L of 3 μm.

Step b: A thin film of organic palladium compound was formed on the substrate 1 that carries thereon the device electrodes 4 and 5 by applying an organic palladium solution prepared by dissolving an organic palladium compound formed from palladium acetate and amine into butylacetate to the substrate 1. Then, the substrate 1 was baked at 300° C. for 10 minutes in the atmosphere within an oven to decompose and oxide the organic palladium on the substrate 1 until a film 7 of PdO was formed there.

Step c: A cover with dimensions of 300 μm×200 μm was formed on a surface area of the thin film 7, where an electron-emitting region was to be formed, by applying photoresist (OMR83: available from Tokyo Applied Chemistry) and thereafter subjecting it to a photographic exposure and development process.

Step d: The PdO of the portions of the thin film 7 other than the portion masked by the cover 8 was chemically reduced to Pd to make a Pd film 9 by means of formic acid.

Step e: The Pd film 9 was dissolved in and removed by an etching solution prepared by diluting concentrated nitric acid (complying with the concentration standard 12) with water by 50% (hereinafter referred to as "nitric acid 50% water solution"). Subsequently, the cover 8 was removed by UV ozone ashing to produce a fine particle film 3 (where an electron-emitting region was to be formed in later stage) of PdO.

Note that the term "a fine particle film" as used herein refers to a thin film constituted of a large number of fine particles that may be loosely dispersed, tightly arranged or mutually and randomly overlapping (to form an island structure under certain conditions).

Step f: The substrate 1 carrying thereon a pair of device electrodes 4 and 5 and a electroconductive thin film 3 disposed between the electrodes 1 was then set in position in the vacuum chamber 55 of a gauging system as illustrated in FIG. 3 and the inside of the vacuum chamber was evacuated by means of the exhaust pump 56 to a degree of vacuum of about $1\times10^{-6}$ Torr. Subsequently, a voltage Vf was applied from the power source 51 to the device electrodes 5, 6 to electrically forming the device and produce an electron-emitting region 2 in the electroconductive film. FIG. 6A shows the voltage waveform used for the electric forming process.

In FIG. 6A, T1 and T2 respectively denote the pulse width and the pulse interval of the applied pulse voltage, which were respectively 1 millisecond and 10 milliseconds for this example. The wave height (the peak voltage for the forming operation) of the applied pulse voltage was 5 V and the forming operation lasted about 60 seconds.

With the above described arrangement, the specimens of electron-emitting devices were observed for electron emitting performance.

In the above observation, the distance between the anode and the electron-emitting device was 4 mm and the potential of the anode 54 was 1 kV, while the degree of vacuum in the vacuum chamber 55 of the system was held to $1\times10^{-6}$ Torr throughout the gauging operation.

A device voltage was applied between the device electrodes 5, 6 of the device to see the device current If and the emission current Ie under that condition. The solid lines of FIG. 4 shows the current-voltage relationships obtained as a result of the observation for all the specimens. The emission current began to rapidly increase when the device voltage became as high as 8 V and a device current Ie of 1.1 mA and an emission current of 0.45 μA were observed when the device voltage rose to 14 V.

It will be appreciated that the number of steps required for producing an electron-emitting device is significantly reduced with this manufacturing method by employing a selective chemical reduction technique and wet etching for the formation of an electroconductive thin film 3 having a desired profile if compared with conventional methods.

EXAMPLE 2

In this example, several specimens of surface conduction electron-emitting device were also prepared in Mode 1 described above.

Steps a through c identical with those of Example 1 were followed to produce a PdO film 7 for each specimen and a patterned cover 8 of photoresist was formed thereon. The device electrodes 4 and 5 were prepared by sequentially forming a Ti film and an Ni film to a two layered structure having thicknesses of 50 Å and 1,000 Å respectively.

Step d: The device was exposed to a reducing atmosphere to change the PdO film into a Pd film. The reducing atmosphere was in fact a mixed gas containing hydrogen gas diluted by argon to a ratio of 2% of hydrogen to 98% of argon. While hydrogen gas is explosive and requires particular attention for handling, the lowest content level of hydrogen in air for explosion is 4%. So, by utilizing a mixture containing hydrogen lower than this level, the use of a specific anti-explosion arrangement could be eliminated to simplify the overall equipment.

The device was exposed to the above atmosphere at room temperature for 60 minutes, when PdO was reduced to Pd, which was in the form of discontinuous fine particle film, showing an extremely weak adhesive force relative to the substrate when compared with PdO. So, if put on a substrate, they can easily come off once scrubbed with a brush.

Step e: The devices was immersed in ethanol and cleansed by means of ultrasonic waves. Since reduced Pd fine particles hardly adhered to the substrate, they were removed easily and completely from the substrate.

The device was then dried and the cover 8 was removed by means of UV ozone ashing to produce a patterned thin film 3 of PdO fine particles, where an electron-emitting region was to be formed.

Step f: An electron-emitting region 2 was formed in the thin film 3 in an electric forming operation as in the case of Example 1.

When tested for the performance of the prepared specimens, the results were similar to those of Example 1.

EXAMPLE 3

Step a: As in the case of Example 1, a pair of device electrodes 4 and 5 were prepared on a quartz substrate by sequentially forming a Ti film and a Pt film to a two layered structure having thicknesses of 50 Å and 1,000 Å respectively.

Step b: Also as in the case of Example 1, a thin film of organic palladium compound was formed on the substrate 1 that carries thereon the device electrodes 4 and 5 by applying with a spin coating technique an organic palladium solution prepared by dissolving an organic palladium compound formed from palladium acetate and amine into butylacetate to the substrate 1. Then, the substrate 1 was baked at 300° C. for 10 minutes in the atmosphere until a film 7 of PdO was formed there.

Step c: A cover was formed on a surface area of the thin film 7, where an electron-emitting region was to be formed, by applying photoresist (OMR83: available from Tokyo Applied Chemistry) as in the case of Example 1.

Step d: The PdO of the portions of the thin film other than the portion masked by the cover was chemically reduced to Pd to make a Pd film by immersing the device into formic acid.

Step e: The photoresist was removed by means of a photoresist remover agent (OMR Remover Solution: available from Tokyo Applied Chemistry). At this stage, the material of the portion of the film covered by the covering layer remained to be PdO, whereas that of the remaining portions of the thin film had turned to Pd. The Pd film was removed by etching, using a nitric acid 50% water solution to produce a patterned thin film 3 of PdO, where an electron-emitting region was to be formed.

Step f: An electron-emitting region 2 was formed in the thin film 3 in an electric forming operation as in the case of Example 1.

When tested for the performance of the prepared specimens with a gauging system of FIG. 3, the results were similar to those of Example 1.

EXAMPLE 4

In this example, several specimens of surface conduction electron-emitting device having a configuration as shown in FIGS. 2A and 2B were prepared in Mode 2 described above. The specimens were prepared by following the steps as described below by referring to FIGS. 7A through 7E, which correspond to Steps a through f respectively.

Step a: A pair of device electrodes 4 and 5 were formed on a quartz substrate 1 as in the case of Example 1.

Step b: A thin film of organic palladium compound 31 was formed on the substrate 1 by applying with a spin coating technique an organic palladium solution prepared by dissolving palladium acetate and an amine complex into butylacetate to the substrate 1 and then drying the solution.

Step c: An exposure mask 32 having an opening conforming to the profile of an electron-emitting thin film including an electron-emitting region to be formed there was arranged on the substrate to cover the latter and the organic palladium compound thin film 31 on the substrate was then irradiated with ultraviolet rays 33 at the opening, while being heated and kept to 250° C. by a heater 34 for 3 hours. This is a temperature at which the above organic palladium compound is decomposed to produce metal palladium. A mercury lamp was used for the source of ultraviolet rays.

Step d: The portion of the organic metal compound thin film irradiated with ultraviolet rays turned to a PdO film 35 as it was oxidized at an accelerated rate, whereas the remaining portion of the film became a Pd film 36.

Step e: The Pd film 36 was selectively etched and removed to produce an electroconductive thin film 3 having a desired profile, where an electron-emitting region was to be formed, using nitric acid 50% water solution as an etchant.

Step f: An electron-emitting region 2 was formed in the thin film 3 in an electric forming operation as in the case of Example 1.

When tested for the electron emitting performance of the prepared specimens with a gauging system of FIG. 3, the following results were obtained. A device current of If=3.0 mA and an emission current of Ie=1.5 μA for a device voltage of 16 V or an electron-emitting efficiency of $\eta$=0.05%.

EXAMPLE 5

In this example, several specimens of surface conduction electron-emitting device having a configuration as shown in FIGS. 2A and 2B were prepared in Mode 2 described above. The specimens were prepared by following the steps as described below.

As in the case of Steps a and b of Example 4 above, a pair of device electrodes were formed on a quartz substrate and then a thin film of an organic palladium compound was formed thereon as in the case of Example 1.

Step c: The device was heated in an inert gas atmosphere within an over and kept to 200° C. for 1 hour. As a result, the organic palladium compound was decomposed to totally become metal palladium.

Step d: An exposure mask having an opening conforming to the profile of an electron-emitting thin film including an electron-emitting region to be formed there was arranged on the substrate to cover the latter and the opening was then irradiated with ultraviolet rays for 3 hours. Under this condition, the device was heated to 250° C. A mercury lamp was used for the source of ultraviolet rays as in the case of Example 4.

Step e: The portion of the organic palladium compound thin film irradiated with ultraviolet rays in Step d turned to a PdO film, whereas the remaining portion of the film became a Pd film 36.

Step f: The Pd film was selectively etched and removed to produce an electroconductive thin film 3 having a desired profile, where an electron-emitting region was to be formed, using nitric acid 50% water solution as an etchant.

Step g: An electron-emitting region was formed in the electroconductive thin film in an electric forming operation as in the case of Example 4.

When tested for the performance of the prepared specimens with a gauging system as in the case of Example 1, the results were similar to those of Example 4.

EXAMPLE 6

In this example, several specimens of surface condition electron-emitting device having a configuration as shown in FIGS. 2A and 2B were prepared in Mode 3 described above. The specimens were prepared by following the steps as described below.

A pair of device electrodes were formed on a quartz substrate as in Step 1 of Example 4 and then an organic palladium compound thin film was formed thereon as in Step b of Example 4.

Step c: The portion of the thin film where an electroconductive thin film including an electron-emitting region was to be formed was scanned by a laser spot of argon ion laser, while the device was heated and kept to 250° C. in the atmosphere. The parameters including the scanning speed of the laser spot were so determined that the temperature of the spot of the thin film being hit by laser was raised to 300° C.

Step d: The portion of the organic palladium compound thin film scanned by a laser spot in Step c turned to a PdO film as a result of oxidation, whereas the remaining portion of the film became a Pd film as a result of outright decomposition.

Step e: The Pd film was selectively etched and removed to produce an electroconductive thin film having a desired profile, where an electron-emitting region was to be formed.

Step f: An electron-emitting region was formed in the electroconductive thin film in an electric forming operation as in the case of Example 1.

When tested for the performance of the prepared specimens with a gauging system illustrated in FIG. 3, the results were similar to those of Example 4.

EXAMPLE 7

In this example, several specimens of surface conduction electron-emitting device having a configuration as shown in FIGS. 2A and 2B were prepared in Mode 4 described above. The specimens were prepared by following the steps as described below.

Step a: A pair of device electrodes were formed on a quartz substrate as in Example 1, although Ti and Ni were sequentially deposited on the substrate to respective thicknesses of 50 Å and 1,000 Å to produce a two layered structure in this example. The electrodes were separated from each other by a distance L of 2 μm and had a width W of 500 μm.

Step b: An organic palladium compound thin film was formed as in Example 4.

Step c: An electroconductive portion as large as 200 μm×300 μm, where an electron-emitting region was to be formed, was produced out of the organic metal compound thin film between the device electrodes to bridge the latter. This was done by scanning the organic palladium compound film with a laser spot of argon ion laser in such a way that the ion laser was turned on and off in synchronism with the scanning motion going into and out of the desired portion that was to be turned into an electroconductive thin film in order to heat and bake only the desired portion. The parameters including the scanning speed of the laser spot were so determined that the temperature of the spot of the thin film being hit by laser was raised to about 300° C.

Step d: The portion of the organic palladium compound thin film scanned by a laser spot in Step c turned to a PdO film as a result of decomposition and oxidation, whereas the remaining portion of the film remained an organic palladium compound.

Step e: The device was heated to and kept at 120° C. for 60 minutes. With this operation, the portion of the organic palladium compound that had not been baked in Step d was caused to sublimate and disappear from the substrate.

Step f: An electron-emitting region was formed in the electroconductive thin film in an electric forming operation as in the case of Example 1.

When tested for the electron emitting performance of the prepared specimens, the following results were obtained. A device current of If=2.2 mA and an emission current of Ie=2.2 μA with a device current of 14 V or an electron-emitting efficiency of η=0.05%.

EXAMPLE 8

In this example, several specimens of surface conduction electron-emitting device having a configuration as shown in FIGS. 2A and 2B were prepared in Mode 4 described above. The specimens were prepared by following the steps as described below by referring to FIGS. 8A through 8F, which respectively correspond to Steps a through f below.

Step a: A pair of device electrodes were formed on a quartz substrate 1 as in Example 1, although Ti and Ni were sequentially deposited on the substrate to respective thicknesses of 50 Å and 1,000 Å to produce a two layered structure in this example. The electrodes were separated from each other by a distance L of 2 μm and had a width W of 500 μm.

Step b: An organic palladium compound thin film 31 was formed as in Example 4.

Step c: An electroconductive portion as large as 200 μm×300 μm, where an electron-emitting region was to be formed, was produced out of the organic metal compound thin film between the device electrodes 4 and 5 to bridge the latter. This was done by covering the thin film 31 with an exposure mask 32 having a desired pattern and irradiating the thin film 31 with infrared rays coming from an infrared lamp so that only the desired portion of the thin film 31 was baked. The parameters of infrared rays irradiation including the duration of time of irradiation were so determined that the temperature of the directly irradiated area was raised to about 300° C.

Step d: The portion of the organic palladium compound that had been irradiated with infrared rays in Step c was decomposed and oxidized to become a PdO film 35, whereas the remaining portion of the film remained to be an organic palladium compound.

Step e: The device was washed with butylacetate to remove the unbaked organic palladium compound and produce an electroconductive thin film 3, where an electron-emitting region was to be formed.

Step f: An electron-emitting region was formed in the electroconductive thin film in an electric forming operation as in the case of Example 1.

When tested for the performance of the prepared specimens as in Example 1, the results were similar to those of Example 7.

EXAMPLE 9

Specimens were prepared by following Steps a through d as in Example 8. Thereafter, the following steps were carried out.

Step e: The device was heated to and kept at 120° C. for 60 minutes. As a result, the portion of organic palladium compound that had not been baked in Step d was caused to sublimate and disappear from the substrate.

Step f: An electron-emitting region was formed in the electroconductive thin film in an electric forming operation as in the case of Example 1.

When tested for the performance of the prepared specimens as in Example 1, the results were similar to those of Example 7.

EXAMPLE 10

In this example, several specimens of surface conduction electron-emitting device having a configuration as shown in FIGS. 2A and 2B were prepared in Mode 5 described above.

The specimens were prepared by following the steps as described below by referring to FIGS. 13A through 13E, which respectively correspond to Steps a through f below.

Step a: A pair of device electrodes 4 and 5 were formed on a quartz substrate 1 as in Example 1, although Ti and Ni were sequentially deposited on the substrate to respective thicknesses of 50 Å and 1,000 Å to produce a two layered structure in this example. The electrodes were separated from each other by a distance L of 10 μm and had a width W of 300 μm.

Step b: An organic palladium compound thin film 31 was formed on the substrate 1 by dissolving a complex (0.5 wt %) of palladium acetate (Chemical Formula No. 37a) and an anthraquinone derivate (Chemical Formula No. 29) in dimethylsulfoxide, applying the solution to the substrate by means of a spinner coat technique and, thereafter, drying the solution.

Step c: A desired electroconductive portion, where an electron-emitting region was to be formed, was produced out of the organic metal compound thin film by striking the entire portion with a laser beam of a semiconductor laser having a wavelength of 830 mm, an output level of 30 mW, a pulse width of 3 μsec. and a beam diameter of 2 μm, while shifting the substrate at a pitch of 0.5 μm. As a result, organic palladium compound of that portion was decomposed and oxidized to become a PdO film 35, whereas the compound of the remaining portion 36 was not chemically changed.

Step d: The unbaked portion was washed with dimethylsulfoxide and acetone and removed from the substrate to produce an electroconductive thin film 3, where an electron-emitting region was to be formed.

Step f: An electron-emitting region 2 was formed in the electroconductive thin film 3 in an electric forming operation as in the case of Example 1.

When tested for the electron emitting performance of the prepared specimens, the following results were obtained. A device current of If=1.4 mA and an emission current of Ie=10 μA with a device current of 14 V or an electron-emitting efficiency of η=0.07%.

EXAMPLE 11

In this example, several specimens of surface conduction electron-emitting device having a configuration as shown in FIGS. 2A and 2B were prepared in Mode 5 described above. The specimens were prepared by following the steps as described below by referring to FIGS. 13A through 13E, which respectively correspond to Steps a through f below.

Step a: A pair of device electrodes 4 and 5 were formed on a quartz substrate 1 as in Example 1, although Ti and Ni were sequentially deposited on the substrate to respective thicknesses of 50 Å and 1,000 Å to produce a two layered structure in this example. The electrodes were separated from each other by a distance L of 10 μm and had a width W of 300 μm.

Step b: An organic metal compound thin film 31 was formed on the substrate 1 by dispersing a zinc phthalocyanine derivative (Chemical Formula No. 2a, 2 wt %) in polyvinylalcohol, applying the solution to the substrate by means of a spinner coat technique and, thereafter, drying the solution.

Step c: A desired electroconductive portion, where an electron-emitting region was to be formed, was produced out of the organic metal compound thin film by striking the entire portion with a laser beam of a semiconductor laser having a wavelength of 830 mm, an output level of 30 mW, a pulse width of 3 μsec. and a beam diameter of 2 μm, while shifting the substrate at a pitch of 0.5 μm. As a result, organic palladium compound of that portion was decomposed and oxidized to become a PdO film 35, whereas the compound of the remaining portion 36 was not chemically changed.

Step d: The unbaked portion was washed with alcohol and water removed from the substrate to produce an electroconductive thin film 3, where an electron-emitting region was to be formed.

Step f: An electron-emitting region 2 was formed in the electroconductive thin film 3 in an electric forming operation as in the case of Example 1.

When tested for the electron emitting performance of the prepared specimens, the following results were obtained. A device current of If=2.0 mA and an emission current of Ie=1.2 μA with a device current of 14 V or an electron-emitting efficiency of η=0.06%.

EXAMPLE 12

In this example, several specimens of surface conduction electron-emitting device having a configuration as shown in FIGS. 2A and 2B were prepared in Mode 5 described above. The specimens were prepared by following the steps as described below by referring to FIGS. 13A through 13E, which respectively correspond to Steps a through f below.

Step a: A pair of device electrodes 4 and 5 were formed on a quartz substrate 1 as in Example 1, although Ti and Ni were sequentially deposited on the substrate to respective thicknesses of 50 Å and 1,000 Å to produce a two layered structure in this example. The electrodes were separated from each other by a distance L of 10 μm and had a width W of 300 μm.

Step b: An organic metal compound thin film 31 was formed on the substrate 1 by dissolving a near infrared ray absorbing organic metal composition consisting of nickelacetylacetonato (Chemical Formula No. 38b, 1 wt %) and a polymethine type coloring compound (Chemical Formula No. 8, 1 wt %) into butylacetate, applying the solution to the substrate by means of a spinner coat technique and, thereafter, drying the solution.

Step c: A desired electroconductive portion, where an electron-emitting region was to be formed, was produced out of the organic metal compound thin film by striking the entire portion with a laser beam of a semiconductor laser having a wavelength of 830 mm, an output level of 30 mW, a pulse width of 3 μsec. and a beam diameter of 2 μm, while shifting the substrate at a pitch of 0.5 μm. As a result, organic palladium compound of that portion was decomposed and oxidized to become a PdO film 35, whereas the compound of the remaining portion 36 was not chemically changed.

Step d: The unbaked portion was washed with butylacetate and acetone and removed from the substrate to produce an electroconductive thin film 3, where an electron-emitting region was to be formed.

Step f: An electron-emitting region 2 was formed in the electroconductive thin film 3 in an electric forming operation as in the case of Example 1.

When tested for the electron emitting performance of the prepared specimens, the following results were obtained. A device current of If=0.8 mA and an emission current of Ie=0.8 μA with a device current of 14 V or an electron-emitting efficiency of η=0.1%.

EXAMPLE 13

In this example, several specimens of surface conduction electron-emitting device having a configuration as shown in FIGS. 2A and 2B were prepared in Mode 6 described above. The specimens were prepared by following the steps as described below.

Step a: A pair of device electrodes were formed on a quartz substrate 1 as in Example 1, although Ti and Pt were sequentially deposited on the substrate to respective thicknesses of 50 Å and 300 Å to produce a two layered structure in this example.

Step b: An organic palladium compound thin film was formed on the substrate by dissolving a compound consisting of palladium acetate and amine into butylacetate, applying the solution to the substrate by means of a spinner coat technique and, thereafter, drying the solution.

Step c: The substrate carrying thereon an organic palladium compound film was covered with an exposure mask having an opening of a desired pattern and irradiated with ultraviolet rays by means of a commercially available UV ozone ashing apparatus (UV-300: available from Semco International) in an ozone atmosphere for 2 hours.

At this stage of operation, the organic palladium compound of the portion that has been irradiated with ultraviolet rays was almost totally decomposed and the bond between the organic component and palladium was cut. So, a chemical difference existed in the film between the portion that had been irradiated with ultraviolet rays and the remaining portion that had not been irradiated with ultraviolet rays.

Step d: Then, the device was held to 120° C. in the atmosphere. As a result, the organic palladium compound of the portion that had not been irradiated with ultraviolet rays was caused to sublimate and disappear from the substrate, whereas the organic component of the portion that had been irradiated with ultraviolet rays was also removed, while the palladium of that portion was left on the substrate to complete the patterning operation.

Step e: Subsequently, the device was heated and held to 300° C. for 10 minutes. The Pd of the remaining film was consequently oxidized to become PdO to produce an electroconductive thin film, where an electron-emitting region was to be formed.

Step f: An electron-emitting region was formed in the electroconductive thin film in an electric forming operation as in the case of Example 1.

When tested for the electron emitting performance of the prepared specimens, the following results were obtained. A device current of If=2.2 mA and an emission current of Ie=1.1 μA with a device current of 14 V or an electron-emitting efficiency of $\eta$=0.05%.

EXAMPLE 14

In this example, several specimens of surface conduction electron-emitting device having a configuration as shown in FIGS. 2A and 2B were prepared in Mode 6 described above. The specimens were prepared by following the steps as described below by referring to FIGS. 9A through 9F, which respectively correspond to Steps a through f below.

Step a: A pair of device electrodes 4 and 5 were formed on a quartz substrate 1 as in Example 1, although Ti and Pt were sequentially deposited on the substrate to respective thicknesses of 50 Å and 300 Å to produce a two layered structure in this example.

Step b: An organic palladium compound thin film was formed on the substrate 1 by dissolving a compound consisting of palladium acetate and amine into butylacetate, applying the solution to the substrate by means of a spinner coat technique and, thereafter, drying the solution.

Step c: The organic palladium compound film 6 was irradiated with ultraviolet rays by means of N2 laser 37 (having a wavelength of 337.1 nm: available from Japan Spectrum Industries Co., Ltd.). The spot diameter of the generated laser was reduced to 2 μm by a focusing lens 38 before scanning the device. In this scanning operation, the laser was turned on and off in synchronism with the scanning motion going into and out of the desired portion of the film 6 that was to be turned into an electroconductive thin film.

At this stage of operation, the organic palladium compound of the portion that has been irradiated with ultraviolet rays was almost totally decomposed and the bond between the organic component and palladium was cut. So, a chemical difference existed in the film between the portion that had been irradiated with ultraviolet rays and the remaining portion that had not been irradiated with ultraviolet rays.

Step d: Then, the device was held to 120° C. by means of a heater 34 in the atmosphere. As a result, the organic palladium compound of the portion that had not been irradiated with ultraviolet rays was caused to sublimate and disappear from the substrate, whereas the organic component of the portion that had been irradiated with ultraviolet rays was also removed, while the palladium of that portion was left on the substrate.

Additionally, the device was then dipped in butylacetate to dissolve and remove any organic palladium compound remaining on the substrate. The composition product, or Pd, was left on the substrate and the patterning operation was completed.

Step e: Subsequently, the device was heated and held to 300° C. for 15 minutes. The Pd of the remaining film was consequently oxidized to become PdO to produce an electroconductive thin film 3, where an electron-emitting region was to be formed.

Step f: An electron-emitting region 2 was formed in the electroconductive thin film 3 in an electric forming operation as in the case of Example 1.

When tested for the electron emitting performance of the prepared specimens, the following results were obtained. A device current of If=3.0 mA and an emission current of Ie=1.5 μA with a device current of 14 V or an electron-emitting efficiency of $\eta$=0.05%.

EXAMPLE 15

In this example, an electron source comprising a plurality of electron-emitting devices and an image-forming apparatus incorporating such an electron source were prepared in Mode 7 of realizing the present invention.

FIG. 10 shows a schematic plan view of the electron source prepared by arranging electron-emitting devices into a matrix and FIG. 11 shows a partially cutaway schematic perspective view of the image-forming apparatus incorporating the electron source.

Figure 14:
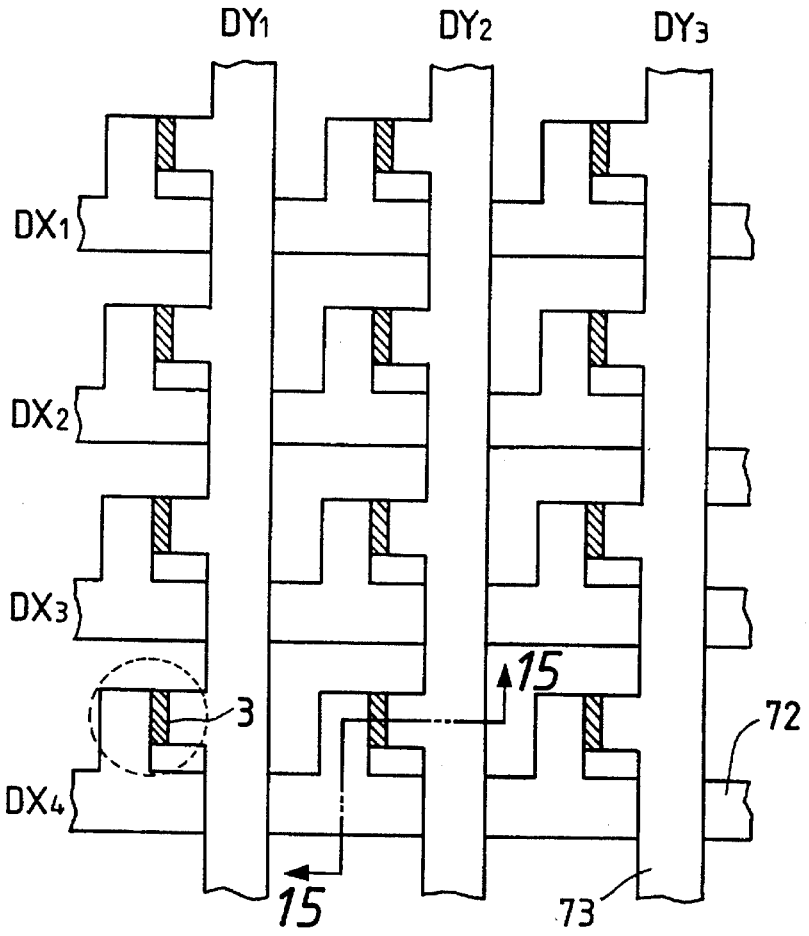
FIG. 14 is a schematic partial plan view of an electron source prepared in Example 15, which will be described hereinafter.
Figure 15:
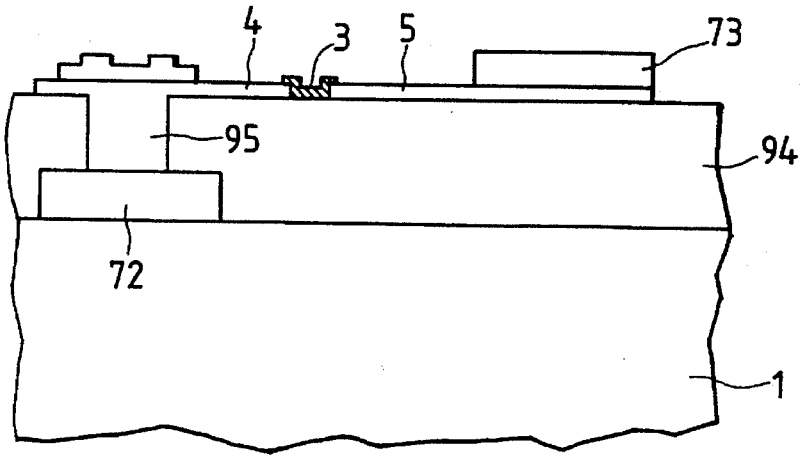
FIG. 15 is a schematic sectional view taken along line 15—15 in FIG. 14.
Figure 16A:
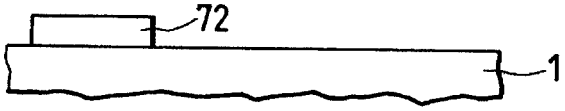
FIGS. 16A through 16H schematically show different steps of manufacturing an electron source used in Example 15, which will be described hereinafter.
Figure 16B:
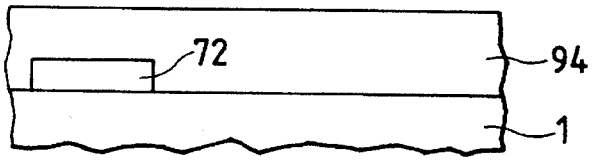
Figure 16C:
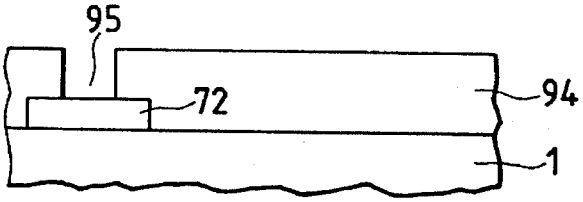
Figure 16D:
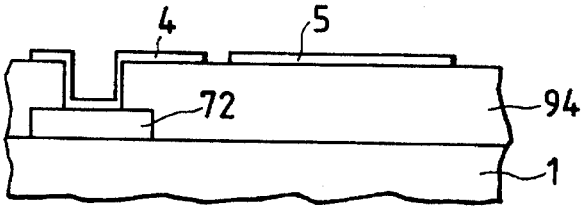
Figure 16E:
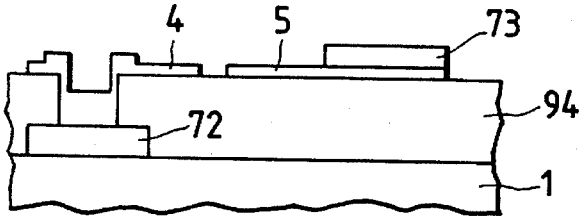
Figure 16F:
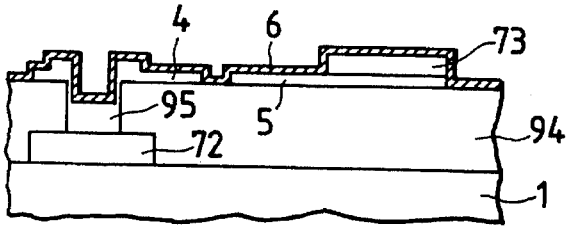
Figure 16G:
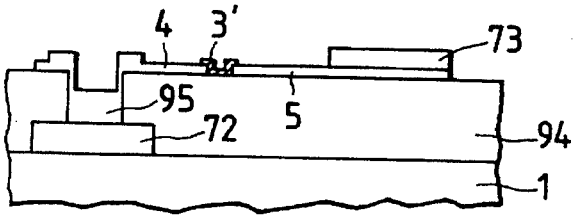
Figure 16H:
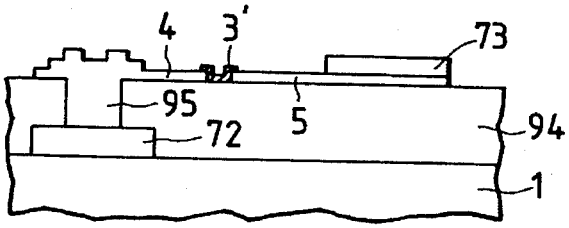

FIG. 14 is an enlarged schematic partial plan view of the electron source and FIG. 15 is a schematic partial sectional view taken along line 15—15 of FIG. 14, while FIGS. 16A through 16H illustrate schematic partial sectional views of the electron source shown in different manufacturing steps.

Note that same or similar components are respectively designated by same reference symbols throughout FIGS. 10, 11, 14, 15 and 16A through 16H.

In these figures, 72 and 73 respectively denote X- and Y-directional wirings (which may be called lower and upper wirings respectively). Otherwise, the electron source comprises electron-emitting devices, each having an electroconductive film 3 including an electron-emitting region and a pair of device electrodes 4 and 5, an interlayer insulation layer 94 and a number of contact holes 95, each of which is used to connect a device electrode 5 with a related lower wiring 72.

Now, the steps of manufacturing an electron source and an image-forming apparatus incorporating such as electron source used in this example will be described in detail by referring to FIGS. 16A through 16H, which respectively correspond to Steps a through h below.

Step a: After thoroughly cleaning a soda lime glass plate 1, Cr and Au were sequentially laid to thicknesses of 50 Å and 6,000 Å respectively and then a photoresist (AZ1370: available from Hoechst Corporation) was formed thereon by means of a spinner, while rotating the film, and baked. Thereafter, a photomask image was exposed to light and developed to produce a resist pattern for lower wirings 72 and then the deposited Au/Cr film was wet-etched to produce lower wirings 72 having a desired profile.

Step b: A Silicon oxide film was formed as an interlayer insulation layer 94 to a thickness of 0.1 μm by RF sputtering.

Step c: A photoresist pattern was prepared for producing contact holes 95 in the silicon oxide film deposited in Step b, which contact holes 95 were then actually formed by etching the interlayer insulation layer 94, using the photoresist pattern for a mask. RIE (Reactive Ion Etching) using $CF_4$ and $H_2$ gas was employed for the etching operation.

Step d: Thereafter, a pattern of photoresist (RD-2000N-41: available from Hitachi Chemical Co., Ltd.) was formed for pairs of device electrodes 4 and 5 and gaps separating the respective pairs of electrodes and then Ti and Ni were sequentially deposited thereon respectively to thicknesses of 50 Å and 1,000 Å by vacuum deposition. The photoresist pattern was dissolved by an organic solvent and the Ni/Ti deposit film was treated by using a lift-off technique to produce pairs of device electrodes 4 and 5, each pair having a width W1 of 300 μm and separated from each other by a distance L1 of 3 μm.

Step e: After forming a photoresist pattern on the device electrodes 4, 5 for upper wirings 73, Ti and Au were sequentially deposited by vacuum deposition to respective thicknesses of 50 Å and 5,000 Å and then unnecessary areas were removed by means of a lift-off technique to produce upper wirings 73 having a desired profile.

Step f: An organic palladium composition consisting of palladium acetate and amine was applied on the product of Step e to produce an organic palladium thin film 6.

Step g: The entire surface of the substrate was scanned by a laser beam of argon ion laser in such a way that the ion laser was turned on and off in synchronism with the scanning motion going into and out of each of desired portions that were to be turned into electroconductive thin films, where electron-emitting regions were to be formed, in order to heat and bake only the desired portions. Consequently, the organic palladium compound of these portions were turned to palladium oxide. Subsequently, the organic palladium compound film of the unbaked portions was washed and removed with butylacetate to produce a plurality of thin films 3, where electron-emitting regions were to be formed.

Step h: Then, photoresist was applied to the entire surface area of the substrate and the substrate was exposed to light, using a mask, and photographically developed. Thereafter, the resist was removed only at the contact holes 95. Subsequently, Ti and Au were sequentially deposited by vacuum deposition to respective thicknesses of 50 Å and 5,000 Å. Any unnecessary areas were removed by means of a lift-off technique to consequently bury the contact holes 95.

Now, lower wirings 72, an interlayer insulation layer 94, upper wirings 73, pairs of device electrodes 4 and 5 and electroconductive films 3 including electron-emitting regions were produced on the substrate 1.

Then, an electron source comprising the above electron source substrate and an image-forming apparatus incorporating such an electron source were prepared, although the electron source had not been subjected to an electric forming process. This will be described below by referring to FIGS. 11 and 12.

The electron source 81 that had not been subjected to an electric forming process was rigidly fitted to a rear plate 82 and thereafter a face plate 90 (prepared by forming a fluorescent film 88 and a metal back 89 on a glass substrate 87) was arranged 5 mm above the electron source 81 by interposing a support frame 83 therebetween. Frit glass was applied to junction areas of the face plate 90, the support frame 83 and the rear plate 82, which were then baked at 400° C. to 500° C. for 10 minutes in the atmosphere and bonded together to a hermetically sealed condition (FIG. 11). The electron source 81 was also firmly bonded to the rear plate 82 by means of frit glass.

While the fluorescent film 88 may be solely made of fluorescent bodies if the image-forming apparatus is for black and white pictures, firstly black stripes were arranged and then the gaps separating the black stripes were filled with respective phosphor substances for the primary colors to produce a fluorescent film for this example (See FIG. 12A). The black stripes were made of a popular material containing graphite as a principal ingredient. The phosphor substances were applied to the glass substrate 87 by using a slurry method.

A metal back 89 is normally arranged on the inner surface of the fluorescent film 88. In this example, a metal back was prepared by producing an Al film by vacuum deposition on the inner surface of the fluorescent film 88 that had been smoothed in a so-called filming process. The face plate 90 may be additionally provided with transparent electrodes arranged close to the outer surface of the fluorescent film 88 in order to improve the conductivity of the fluorescent film 88, no such electrodes were used in this example because the metal back proved to be sufficiently conductive. The pieces of phosphor substances were carefully aligned with the respective electron-emitting devices before the above described bonding operation.

The prepared glass container was then evacuated by means of an exhaust pipe (not shown) and an exhaust pump to achieve a sufficient degree of vacuum inside the container. Thereafter, the electroconductive film of each of the electron-emitting devices arranged on the substrate was subjected to an electric forming operation, where a voltage was applied to the device electrodes of the electron-emitting devices by way of the external terminals Doxl through Doxm and Doyl through Doyn to produce an electron-emitting region in each electroconductive film as in Example 1.

The electron-emitting devices of the prepared apparatus were subsequently subjected to an operation of activation by applying a rectangular pulse voltage at 14 V to each device. The pulse had an interval of 10 msec. and a pulse width of 100 μsec. The pulse voltage was applied to all the devices of each device column simultaneously for about 30 minutes.

Thereafter, the devices were subjected to an operation of stabilization, where the devices were driven to operate for 10 hours while the glass container of the apparatus was evacuated by means of an oil-free exhaust system and heated to 150° C. The inside of the container proved to be in a vacuum condition of $1\times10^{-7}$ Torr when the heating was stopped and the container was cooled to room temperature. Both the device current If and the emission current Ie showed an MI characteristic relative to the device voltage Vf.

Then, the exhaust pipe was sealed by heating it with a gas burner to obtain a hermetically sealed glass container. Finally, a getter operation was carried out in order to maintain a high degree of vacuum in the glass container.

The finished image-forming apparatus was operated by applying a voltage to each electron-emitting device by way of the external terminals Doxl through Doxm and Doyl through Doyn to cause the electron-emitting devices to emit electrons. Meanwhile, a high voltage of greater than several kV was applied to the metal back 89 or the transparent electrode (not shown) by way of a high voltage terminal Hv to accelerate electron beams and cause them to collide with the fluorescent film 88, which by turn was energized to emit light to display intended images.

EXAMPLE 16

Figure 17:
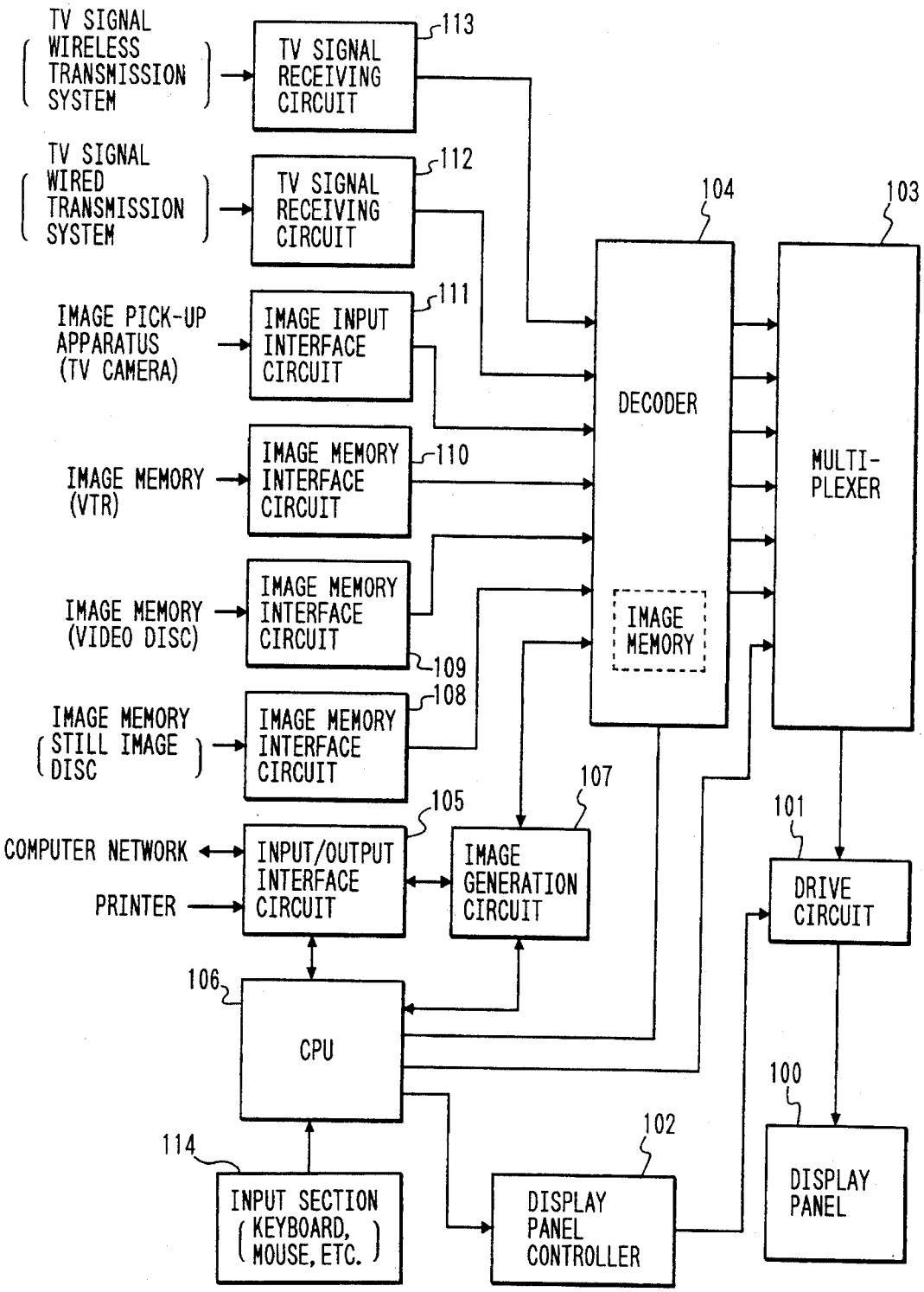
FIG. 17 is a block diagram showing the configuration of an image-forming apparatus prepared in Example 16, which will be described hereinafter.

FIG. 17 is a block diagram of the display apparatus (display panel) prepared in Example 15 and designed to display a variety of visual data as well as pictures of television transmission and other sources in accordance with input signals coming from different signal sources. Referring to FIG. 17, the apparatus comprises a display panel 100, a display panel drive circuit 101, a display controller 102, a multiplexer 103, a decoder 104, an input/output interface circuit 105, a CPU 106, an image generation circuit 107, image memory interface circuits 108, 109 and 110, an image input interface circuit 111, TV signal receiving circuits 112 and 113 and an input section 114. (If the display apparatus is used for receiving television signals that are constituted by video and audio signals, circuits, speakers and other devices are required for receiving, separating, reproducing, processing and storing audio signals along with the circuits shown in the drawing. However, such circuits and devices are omitted here in view of the scope of the present invention). Now, the components of the apparatus will be described, following the flow of image data therethrough.

Firstly, the TV signal reception circuit 113 is a circuit for receiving TV image signals transmitted via a wireless transmission system using electromagnetic waves and/or spatial optical telecommunication networks. The TV signal system to be used is not limited to a particular one and any system such as NTSC, PAL or SECAM may feasibly be used with it. It is particularly suited for TV signals involving a larger number of scanning lines (typically of a high definition TV system such as the MUSE system) because it can be used for a large display panel comprising a large number of pixels. The TV signals received by the TV signal reception circuit 113 are forwarded to the decoder 104.

Secondly, the TV signal reception circuit 112 is a circuit for receiving TV image signals transmitted via a wired transmission system using coaxial cables and/or optical fibers. Like the TV signal reception circuit 113, the TV signal system to be used is not limited to a particular one and the TV signals received by the circuit are forwarded to the decoder 104.

The image input interface circuit 111 is a circuit for receiving image signals forwarded from an image input device such as a TV camera or an image pick-up scanner. It also forwards the received image signals to the decoder 104.

The image memory interface circuit 110 is a circuit for retrieving image signals stored in a video tape recorder (hereinafter referred to as VTR) and the retrieved image signals are also forwarded to the decoder 104.

The image memory interface circuit 109 is a circuit for retrieving image signals stored in a video disc and the retrieved image signals are also forwarded to the decoder 104.

The image memory interface circuit 108 is a circuit for retrieving image signals stored in a device for storing still image data such as so-called still disc and the retrieved image signals are also forwarded to the decoder 104.

The input/output interface circuit 105 is a circuit for connecting the display apparatus and an external output signal source such as a computer, a computer network or a printer. It carries out input/output operations for image data and data on characters and graphics and, if appropriate, for control signals and numerical data between the CPU 106 of the display apparatus and an external output signal source.

The image generation circuit 107 is a circuit for generating image data to be displayed on the display screen on the basis of the image data and the data on characters and graphics input from an external output signal source via the input/output interface circuit 105 or those coming from the CPU 106. The circuit comprises reloadable memories for storing image data and data on characters and graphics, read-only memories for storing image patters corresponding given character codes, a processor for processing image data and other circuit components necessary for the generation of screen images.

Image data generated by the circuit for display are sent to the decoder 104 and, if appropriate, they may also be sent to an external circuit such as a computer network or a printer via the input/output interface circuit 105.

The CPU 106 controls the display apparatus and carries out the operation of generating, selecting and editing images to be displayed on the display screen.

For example, the CPU 106 sends control signals to the multiplexer 103 and appropriately selects or combines signals for images to be displayed on the display screen. At the same time it generates control signals for the display panel controller 102 and controls the operation of the display apparatus in terms of image display frequency, scanning method (e.g., interlaced scanning or non-interlaced scanning), the number of scanning lines per frame and so on.

The CPU 106 also sends out image data and data on characters and graphic directly to the image generation circuit 107 and accesses external computers and memories via the input/output interface circuit 105 to obtain external image data and data on characters and graphics.

The CPU 106 may additionally be so designed as to participate other operations of the display apparatus including the operation of generating and processing data like the CPU of a personal computer or a word processor.

The CPU 106 may also be connected to an external computer network via the input/output interface circuit 105 to carry out numerical computations and other operations, cooperating therewith.

The input section 114 is used for forwarding the instructions, programs and data given to it by the operator to the CPU 106. As a matter of fact, it may be selected from a variety of input devices such as keyboards, mice, joy sticks, bar code readers and voice recognition devices as well as any combinations thereof.

The decoder 104 is a circuit for converting various image signals input via said circuits 107 through 113 back into signals for three primary colors, luminance signals and I and Q signals. Preferably, the decoder 104 comprises image memories as indicated by a dotted line in FIG. 25 for dealing with television signals such as those of the MUSE system that require image memories for signal conversion. The provision of image memories additionally facilitates the display of still images as well as such operations as thinning out, interpolating, enlarging, reducing, synthesizing and editing frames to be optionally carried out by the decoder 104 in cooperation with the image generation circuit 107 and the CPU 106.

The multiplexer 103 is used to appropriately select images to be displayed on the display screen according to control signals given by the CPU 106. In other words, the multiplexer 103 selects certain converted image signals coming from the decoder 104 and sends them to the drive circuit 101. It can also divide the display screen in a plurality of frames to display different images simultaneously by switching from a set of image signals to a different set of image signals within the time period for displaying a single frame as in the case of a split screen of television broadcasting.

The display panel controller 102 is a circuit for controlling the operation of the drive circuit 101 according to control signals transmitted from CPU 106.

Among others, the display panel 102 operates to transmit signals to the drive circuit 101 for controlling the sequence of operations of the power source (not shown) for driving the display panel in order to define the basic operation of the display panel.

It also transmits signals to the drive circuit 101 for controlling the image display frequency and the scanning method (e.g., interlaced scanning or non-interlaced scanning) in order to define the mode of driving the display panel.

If appropriate, it also transmits signals to the drive circuit 101 for controlling the quality of the images to be displayed on the display screen in terms of luminance, contrast, color tone and sharpness.

The drive circuit 101 is a circuit for generating drive signals to be applied to the display panel 101. It operates according to image signals coming from said multiplexer 103 and control signals coming from the display panel controller 102.

A display apparatus according to the invention and having a configuration as described above and illustrated in FIG. 17 can display on the display panel 100 various images given from a variety of image data sources. More specifically, image signals such as television image signals are converted back by the decoder 104 and then selected by the multiplexer 103 before sent to the drive circuit 101. On the other hand, the display controller 102 generates control signals for controlling the operation of the drive circuit 101 according to the image signals for the images to be displayed on the display panel 100. The drive circuit 101 then applies drive signals to the display panel 100 according to the image signals and the control signals. Thus, images are displayed on the display panel 100. All the above described operations are controlled by the CPU 106 in a coordinated manner.

The above described display apparatus can not only select and display particular images out of a number of images given to it but also carry out various image processing operations including those for enlarging, reducing, rotating, emphasizing edges of, thinning out, interpolating, changing colors of and modifying the aspect ratio of images and editing operations including those for synthesizing, erasing, connecting, replacing and inserting images as the image memories incorporated in the decoder 104, the image generation circuit 107 and the CPU 106 participate such operations. Although not described with respect to the above embodiment, it is possible to provide it with additional circuits exclusively dedicated to audio signal processing and editing operations.

Thus, a display apparatus according to the invention and having a configuration as described above can have a wide variety of industrial and commercial applications because it can operate as a display apparatus for television broadcasting, as a terminal apparatus for video teleconferencing, as an editing apparatus for still and movie pictures, as a terminal apparatus for a computer system, as an OA apparatus such as a word processor, as a game machine and in many other ways.

It may be needless to say that FIG. 17 shows only an example of possible configuration of a display apparatus comprising a display panel provided with an electron source prepared by arranging a number of surface conduction electron-emitting devices and the present invention is not limited thereto. For example, some of the circuit components of FIG. 17 may be omitted or additional components may be arranged there depending on the application. For instance, if a display apparatus according to the invention is used for visual telephone, it may be appropriately made to comprise additional components such as a television camera, a microphone, lighting equipment and transmission/reception circuits including a modem.

Since a display apparatus according to the invention comprises a display panel that is provided with an electron source prepared by arranging a large number of surface conduction electron-emitting device and hence adaptable to reduction in the depth, the overall apparatus can be made very thin. Additionally, since a display panel comprising an electron source prepared by arranging a large number of surface conduction electron-emitting devices is adapted to have a large display screen with an enhanced luminance and provide a wide angle for viewing, it can offer really impressive scenes to the viewers with a sense of presence.

What is claimed is:

1. A method of manufacturing an electron-emitting device comprising a pair of device electrodes and an electroconductive film including an electron-emitting region, characterized in that said method comprises a process of forming an electroconductive film including steps of:

forming a pattern on a thin film containing a metal element on the basis of a difference of chemical state; and removing part of the thin film on the basis of the difference of chemical state.

2. A method of manufacturing an electron-emitting device according to claim 1, wherein said thin film containing a metal element is a thin film of an organic metal compound.

3. A method of manufacturing an electron-emitting device according to claim 2, wherein said thin film of an organic metal compound is formed by applying a solution containing the organic metal compound.

4. A method of manufacturing an electron-emitting device according to claim 1, wherein said step of forming a pattern on the basis of a difference of chemical state comprises a step of selectively reducing part of the thin film of a metal oxide.

5. A method of manufacturing an electron-emitting device according to claim 4, wherein said step of selectively removing part of the thin film comprises a step of etching the reduced region of said thin film of the metal oxide.

6. A method of manufacturing an electron-emitting device according to claim 5, wherein said etching step comprises a step of dipping into acid the thin film of the metal oxide, part of which has been selectively reduced.

7. A method of manufacturing an electron-emitting device according to claim 4, wherein said step of selectively removing part of said thin film comprises a step of removing said reduced region of the metal oxide by physical impact.

8. A method of manufacturing an electron-emitting device according to claim 7, wherein said step of removing by physical impact comprises a step of applying an ultrasonic wave to the thin film of the metal oxide, part of which has been selectively reduced.

9. A method of manufacturing an electron-emitting device according to claim 1, wherein said step of forming a pattern on the basis of a difference of chemical state comprises steps of oxidizing the thin film of the organic metal compound into a thin film of an oxide of the metal and selectively reducing part of said thin film of the metal oxide.

10. A method of manufacturing an electron-emitting device according to claim 9, wherein said step of selectively removing part of said thin film comprises a step of etching said reduced region of the thin film of the metal oxide.

11. A method of manufacturing an electron-emitting device according to claim 10, wherein said etching step comprises a step of dipping into acid the thin film of the metal oxide, part of which has been selectively reduced.

12. A method of manufacturing an electron-emitting device according to claim 9, wherein said step of selectively removing part of said thin film comprises a step of removing said reduced region of the metal oxide by physical impact.

13. A method of manufacturing an electron-emitting device according to claim 12, wherein said step of removing by physical impact comprises a step of applying an ultrasonic wave to the thin film of the metal oxide, part of which has been selectively reduced.

14. A method of manufacturing an electron-emitting device according to claim 9, wherein said step of forming a pattern on the basis of a difference of chemical state comprises steps of oxidizing the thin film of the organic metal compound into a thin film of an oxide of the metal and forming a mask on said thin film of the metal oxide and reducing the region of said thin film not covered by the mask.

15. A method of manufacturing an electron-emitting device according to claim 14, wherein said reducing step comprises a step of dipping into a reducing solution said thin film of the metal oxide, part of which is covered by a mask.

16. A method of manufacturing an electron-emitting device according to claim 15, wherein said reducing solution is a solution of formic acid.

17. A method of manufacturing an electron-emitting device according to claim 14, wherein said reducing step comprises a step of exposing said thin film of the metal oxide, part of which is covered by a mask, to a reducing atmosphere.

18. A method of manufacturing an electron-emitting device according to claim 17, wherein said reducing atmosphere is a hydrogen containing atmosphere.

19. A method of manufacturing an electron-emitting device according to claim 1, wherein said step of forming a pattern on the basis of a difference of chemical state comprises a step of selectively oxidizing part of a thin metal film.

20. A method of manufacturing an electron-emitting device according to claim 19, wherein said step of selectively removing part of said thin film comprises a step of removing the thin film other than the oxidized region by selective etching.

21. A method of manufacturing an electron-emitting device according to claim 20, wherein said etching step comprises a step of dipping into acid the thin film, part of which has been oxidized.

22. A method of manufacturing an electron-emitting device according to claim 1, wherein said step of forming a pattern on the basis of a difference of chemical state comprises steps of pyrolyzing the thin film of the organic metal compound into a thin metal film and selectively oxidizing part of said metal thin film.

23. A method of manufacturing an electron-emitting device according to claim 22, wherein said step of selectively removing part of said thin film comprises a step of removing the thin film other than the oxidized region by selective etching.

24. A method of manufacturing an electron-emitting device according to claim 23, wherein said etching step comprises a step of dipping into acid the thin film, part of which has been oxidized.

25. A method of manufacturing an electron-emitting device according to claim 1, wherein said step of forming a pattern on the basis of a difference of chemical state comprises a step of oxidizing part of said thin film of the organic metal compound by selectively irradiating the thin film with ultraviolet rays in an oxidizing atmosphere at a temperature higher than the decomposition temperature and lower than the oxidizing temperature of the organic metal compound.

26. A method of manufacturing an electron-emitting device according to claim 25, wherein said step of selectively removing part of said thin film comprises a step of removing the thin film comprises a step of removing the thin film comprises a step of removing the thin film other than the oxidized region by selective etching.

27. A method of manufacturing an electron-emitting device according to claim 26, wherein said etching step comprises a step of dipping into acid the thin film, part of which has been oxidized.

28. A method of manufacturing an electron-emitting device according to claim 1, wherein said step of forming a pattern on the basis of a difference of chemical state comprises a step of pyrolyzing the thin film of the organic metal compound into a thin metal film at a temperature higher than the decomposition temperature of the organic metal compound and thereafter oxidizing part of the thin metal film by selectively irradiating the thin metal film with ultraviolet rays in an oxidizing atmosphere at a temperature lower than the oxidizing temperature of the metal.

29. A method of manufacturing an electron-emitting device according to claim 28, wherein said step of selectively removing part of said thin film comprises a step of removing the thin film other than the oxidized region by selective etching.

30. A method of manufacturing an electron-emitting device according to claim 29, wherein said etching step comprises a step of dipping into acid the thin film, part of which has been oxidized.

31. A method of manufacturing an electron-emitting device according to claim 1, wherein said step of forming a pattern on the basis of a difference of chemical state comprises a step of oxidizing part of said thin film of the organic metal compound by selectively irradiating the thin film with rays of light in an oxidizing atmosphere at a temperature higher than the decomposition temperature and lower than the oxidizing temperature of the organic metal compound.

32. A method of manufacturing an electron-emitting device according to claim 31, wherein said step of selectively removing part of said thin film comprises a step of removing the thin film other than the oxidized region by selective etching.

33. A method of manufacturing an electron-emitting device according to claim 32, wherein said etching step comprises a step of dipping into acid the thin film, part of which has been oxidized.

34. A method of manufacturing an electron-emitting device according to claim 1, wherein said step of forming a pattern on the basis of a difference of chemical state comprises a step of oxidizing part of said thin film of the organic metal compound by selectively irradiating the thin film with rays of light.

35. A method of manufacturing an electron-emitting device according to claim 34, wherein said step of selectively removing part of said thin film comprises a step of washing with an organic solving said thin film of the organic metal compound, part of which has been oxidized.

36. A method of manufacturing an electron-emitting device according to claim 34, wherein said step of selectively removing part of said thin film comprises a step of removing said part by causing said thin film of the organic metal compound to sublimate at other than the oxidized region.

37. A method of manufacturing an electron-emitting device according to claim 36, wherein said step of removing by sublimation comprises a step of keeping said thin film to a temperature higher than the sublimation temperature of and lower than the decomposition temperature of said organic metal compound.

38. A method of manufacturing an electron-emitting device according to claim 34, wherein said organic metal compound is a near infrared ray absorbing organic metal compound.

39. A method of manufacturing an electron-emitting device according to claim 38, wherein said near infrared ray absorbing organic metal compound is a compound obtained by introducing a near infrared ray absorbing radical to an organic metal compound.

40. A method of manufacturing an electron-emitting device according to claim 39, wherein said compound obtained by introducing a near infrared ray absorbing radical to an organic metal compound is selected from phthalocyanine type metal complexes, dithiol type metal complexes, mercaptonaphthol type metal complexes, polymethine type metal complexes, naphthoquinone metal complexes, anthraquinone type metal complexes, triphenylmethane type metal complexes and aminium diimmonium type metal complexes.

41. A method of manufacturing an electron-emitting device according to claim 39, wherein said compound obtained by introducing a near infrared ray absorbing radical to an organic metal compound is a complex of palladium acetate and an anthraquinone type derivative.

42. A method of manufacturing an electron-emitting device according to claim 39, wherein said compound obtained by introducing a near infrared ray absorbing radical to an organic metal compound is a zinc phthalocyanine derivative.

43. A method of manufacturing an electron-emitting device according to claim 38, wherein said near infrared ray absorbing organic metal compound is a composition obtained by mixing a near infrared ray absorbing coloring compound and an organic metal compound or an organic complex compound.

44. A method of manufacturing an electron-emitting device according to claim 43, wherein said near infrared ray absorbing coloring substance is selected from phthalocyanine type coloring compounds, polymethine type coloring compounds, naphthoquinone type coloring compounds, anthraquinone type coloring compounds, triphenylmethane type coloring compounds and aminium diimmonium type coloring compounds.

45. A method of manufacturing an electron-emitting device according to claim 43, wherein said organic metal compound or said organic complex compound is a compound selected from acetylacetonato metal complexes.

46. A method of manufacturing an electron-emitting device according to claim 43, wherein said near infrared ray absorbing organic metal compound is a composition containing a polymethine type coloring compound and nickel-acetylacetonato.

47. A method of manufacturing an electron-emitting device according to claim 1, wherein said step of forming a pattern on the basis of a difference of chemical state comprises a step of disconnecting the intramolecular bond of the metal constituting the principal component of the organic metal compound and the organic component of said compound in said part of the thin film by selectively irradiating the thin film of organic metal compound with ultraviolet rays.

48. A method of manufacturing an electron-emitting device according to claim 47, wherein said step of selectively removing part of said thin film comprises a step of removing through sublimation said thin film of the organic metal compound other than the region irradiated with ultraviolet rays.

49. A method of manufacturing an electron-emitting device according to claim 48, wherein said step of removing through sublimation comprises a step of keeping said thin film to a temperature higher than the sublimation temperature and lower than the decomposition temperature of said organic metal compound.

50. A method of manufacturing an electron-emitting device according to claim 47, wherein said step of selectively removing said thin film comprises a step of dipping said thin film into a solvent capable of dissolving said organic metal compound.

51. A method of manufacturing an electron-emitting device according to any of claims 1 through 50, further comprising a step of forming an electron-emitting region in said electroconductive thin film.

52. A method of manufacturing an electron-emitting device according to claim 51, wherein said step of forming an electron-emitting region comprises a step of electrically energizing said electroconductive film.

53. A method of manufacturing an image-forming apparatus comprising an electron source having a plurality of electron-emitting devices, each having an electroconductive thin film including an electron-emitting region disposed between a pair of electrodes, modulation means for modulating electron beams emitted from said electron source and an image-forming member for forming images thereon when irradiated with electron beams emitted from said electron source, characterized in that said electron-emitting devices are manufactured by a method according to any of claims 1 through 50.

54. A method of manufacturing an image-forming apparatus according to claim 53, wherein said plurality of electron emitting devices are arranged in parallel columns and said electron emitting devices of each column are electrically connected in parallel with each other by at least one common wiring to drive each of said plurality of electron emitting devices independently.

* * * * *

UNITED STATES PATENT AND TRADEMARK OFFICE

CERTIFICATE OF CORRECTION

PATENT NO. : 5,622,634

DATED : April 22, 1997

INVENTORS : TAKASHI NOMA ET AL.

It is certified that error appears in the above-identified patent and that said Letters Patent is hereby corrected as shown below:

COLUMN 1

Line 57, "paid" should read --made--.

COLUMN 6

Line 13, "such" should read --such as--.

COLUMN 7

Line 23, "such" should read --such as--.

COLUMN 16

Formula (1) (1d) "$-CH_3\rightarrow_3$" should read -- $-(CH_3)$--.

COLUMN 34

Line 25, "over" should read --oven--.

COLUMN 41

Line 20, "Silicon" should read --silicon--.

UNITED STATES PATENT AND TRADEMARK OFFICE

CERTIFICATE OF CORRECTION

PATENT NO. : 5,622,634

DATED : April 22, 1997

INVENTORS : TAKASHI NOMA ET AL.

It is certified that error appears in the above-identified patent and that said Letters Patent is hereby corrected as shown below:

COLUMN 44

Line 26, "patters" should read --patterns--.

COLUMN 48

Line 31, "comprises a step of removing the thin" should be deleted;

Line 32, "film comprises a step of removing the thin film" should be deleted.

Signed and Sealed this

Twenty-third Day of December, 1997

Bruce Lehman

*Attest:*

BRUCE LEHMAN

*Attesting Officer*

*Commissioner of Patents and Trademarks*